US006004217A

United States Patent [19]

Johnston et al.

[11] Patent Number: 6,004,217

[45] Date of Patent: Dec. 21, 1999

[54] FLEXIBLE DASHER BOARD SYSTEM

[75] Inventors: Gary A. Johnston, Waterloo; Bruce W. Irving, Brampton, both of Canada

[73] Assignee: Athletica, Inc., Minneapolis, Minn.

[21] Appl. No.: 09/232,893

[22] Filed: Jan. 15, 1999

Related U.S. Application Data

[60] Provisional application No. 60/071,780, Jan. 19, 1998, abandoned.

[51] Int. Cl.[6] ..... A63C 19/00

[52] U.S. Cl. ..... 472/92; 472/94; 256/24

[58] Field of Search ..... 472/92, 94; 256/24, 256/25, 26; 52/204.51, 204.62, 204.66; 62/235

[56] References Cited

U.S. PATENT DOCUMENTS 3,727,888 4/1973 Nickolas .
3,844,539 10/1974 Abbott .
3,883,120 5/1975 Tippmann .
4,883,267 11/1989 Burley .
4,905,970 3/1990 Holmsten et al. .
5,706,625 1/1998 Vallance et al. .
5,863,030 1/1999 Kotler et al. ..... 256/24

*Primary Examiner*—Kien T. Nguyen
*Attorney, Agent, or Firm*—Greenburg, Traurig

[57] ABSTRACT

A flexible dasher board assembly and system that utilizes four different aspects for providing shock absorbing features in order to absorb any of four different types of forces imparted thereon by players. In a first aspect, the entire dasher board assembly is provided with rotational flexibility such that the entire dasher board assembly will pivot about a point substantially near the bottom of the dasher board and close to the ice. In a second aspect, the entire dasher board system is provided with translational flexibility, such that the entire dasher board assembly can be pushed substantially parallel with and away from the ice. In a third aspect, only the shielding panel is provided with rotational flexibility such that the shielding panel (and its support struts in a supported assembly) will pivot about a point within the dasher board. In a fourth aspect, only the shielding panel is provided with translational flexibility such that only the shielding panel (and its support struts) can be pushed substantially parallel with and away from the ice.

13 Claims, 23 Drawing Sheets

FLEXIBLE DASHER BOARD SYSTEM

CROSS REFERENCE TO RELATED APPLICATIONS

This application is based on and claims filing priority of U.S. Provisional Application Ser. No. 60/071,780, filed on Jan. 19, 1998, now abandoned, which is incorporated by reference herein.

BACKGROUND OF THE INVENTION

This invention relates to dasher boards such as those used in hockey arenas and the like, and in particular to a dasher board system that is flexible and can absorb shock imparted by collisions with hockey players so as to provide a safer environment for the players.

Dasher boards, which are used to form the boundary around arenas such as hockey rinks, are by necessity designed to be secure and stable in order to withstand great impact by hockey players skating or being pushed into the boards during the course of a game. Concerns have been raised, however, about the potentially harmful effects of the stiffness or lack of flexibility of the boards (the terms "stiff or flexible" as used herein describe how much the boards move when hit by a hockey player). That is, when a player hits the boards, there exists is potential for injury. If the boards are very stiff the risk of injury increases. It is noted that the faster speed and the more aggressive playing style of hockey players are making the stiffness of the boards an important issue due to the potential for injuries.

There exists a wide range in the stiffness of various dasher board systems. In some systems available today, the top of the boards may move only about 1/16" (relatively stiff) or as much as 2" to 3" (relatively flexible) when hit by a player. Some systems utilize boards that are mounted to a concrete block wall, which tend to be stiff. Conversely, a light, demountable, aluminum dasher board frame, with loose anchors and bolts, will resultingly be flexible.

There are six main components to a typical dasher board system, each of which can affect how stiff the boards feel to the players. These components are the dasher board, the ice retainer, the anchoring system, the connecting system, the shielding, and the shield mounting system.

Dasher boards are made in two general methods; a fixed, continuous frame or in demountable sections which are typically eight feet long. Both types typically have vertical posts with horizontal stringers. The frame material is normally wood, fiberglass, steel or aluminum. The frame is covered with polyethylene or a fiberglass sheet. A greater amount of material in the frame typically provides a more rigid and stiffer frame. This also increases the weight, which makes the boards feel harder because the greater mass resists movement. Fiberglass and aluminum are more flexible than steel and may create a more flexible board.

An ice retainer (or ice dam) is sometimes used for demountable boards. If the dasher boards are removed, the ice retainer keeps the ice from creeping away from the playing surface. If there is no ice retainer, the boards are often frozen to the concrete, which will make the boards stiffer. With the ice retainer, the boards are less likely to be frozen down. The addition of the ice retainer can create an extra joint or place for the boards to pivot on, giving it more flexibility. The thickness of the ice retainer may determine how it affects the stiffness of the boards. The ice is normally one to 1½" thick. If the ice retainer is 1" thick, the ice may be in contact with the base of the boards. This may cause the boards to be frozen to the ice retainer. If the ice retainer is 2" high, the dasher boards will be above the ice and not frozen down.

The anchors that hold the dasher boards to the concrete can affect how stiff the boards are. For the continuous frames, the posts are welded to anchor plates set in the concrete. This style is normally the stiffest. For the demountable style, an anchor bolt holds the frame to the concrete. More anchors, spaced closer together will make the system stiffer. If too few anchors are used, the ice may push the boards out of alignment. If the anchors are loose, too much movement at the base of the boards may break out chunks of ice along of the boards. It is generally accepted that the base of the boards should be held rigid if they are in contact with the ice.

If there is an ice retainer, there can be two sets of anchors. One set holds the ice retainer to the concrete and the other set holds the dasher boards to the ice retainer or to the concrete behind the ice retainer. The set holding the boards could allow movement between the boards and the ice retainer.

Connecting bolts are used to connect the demountable panels together. Normally there are two or three bolts in the vertical end plate that join one panel to the next in a rigid fashion.

Shielding is normally made of tempered glass or acrylic. Tempered glass is ½" thick (6.54 lb/sq.ft.) on the sides of the arena & ⅝" thick (8.17 lb/sq.ft.) on the ends and radius sections. Acrylic is ½" thick (3.1 lb/sq.ft.) in all locations. The acrylic is more flexible than the glass and at half the weight, it moves easier when hit. Again we note that less mass offers less resistance to movement. The disadvantage of acrylic is that it is more easily marked up and therefore becomes harder to see through. It also requires better securing than glass when mounted or it will bend when hit and be pushed out of its supports. Glass, which is thicker, is required at the ends to prevent breakage by the puck. Unfortunately, this thicker (and heavier) glass is located where the players tend to hit the boards the most.

The advantage of acrylic is its lighter weight which makes for easier handling. The standard thickness of ½" is too flexible to be used in the "seamless" or "supportless" systems without some additional support.

In systems with shield supports, the shields are traditionally mounted between vertical supports (on 4' centers). The supports offer some movement to the shielding. The supports themselves are flexible and they move in the mounting hole and the support bracket. Also, the shielding is held in a gasket that offers some movement. The shielding offers some movement relative to the boards. The shield support could be mounted in a flexible bracket that allows the shield support & shielding to move relative to the boards.

In the new "supportless" or "seamless" style dasher boards, the glass shields are held in a slot or U-channel in the top of the boards. The supportless style holds the glass rigid at the top of the boards. At this point the glass and boards move as one.

FIGS. 1–5 illustrate side views of a traditional prior art dasher board and the various forces the boards are subjected to. FIG. 1 illustrates the dasher board at rest, with no external lateral forces present. FIG. 2 illustrates a lateral force that provides a rotational force about an axis near the interface between the dasher board and the floor. If the boards are hit at the top, the frame pivots about the base slightly and the top of the board moves away from the ice. The upper part of the board moves farther than the lower part. Normally the base of the boards does not lift off the concrete very much. Some designs in the prior art have added springs behind the boards that allow the boards to lift off the concrete, such as in U.S. Pat. No. 4,883,267. In these designs, the ice can deleteriously creep under the boards and prevent it from returning to its rest position.

FIG. 3 illustrates the translational forces that may be imparted on a dasher board assembly. In the prior art, ice may creep into the area near the bottom of the boards, causing misalignment and other problems.

The shielding may also have rotational and/or translational forces subjected thereupon with respect to the boards as shown in FIGS. 4 and 5. As explained below, an improved shock absorbing characteristic of the shielding relative to the boards can be achieved by mounting the shield supports (in the supported design) or the U-channel (in the supportless design) in a fixture that can move within the boards. This would allow the shielding to move away from the playing surface even if the boards did not move.

SUMMARY OF THE INVENTION

The dasher board system of the present invention utilizes four different aspects for providing advantageous shock absorbing features in order to provide for the different types of forces that may be imparted thereon. In a first aspect of the present invention, the entire dasher board assembly is provided with rotational flexibility such that the entire dasher board assembly will pivot about an axis substantially near the bottom of the dasher board and close to the ice. In a second aspect of the present invention, the entire dasher board system is provided with translational flexibility, such that the entire dasher board assembly can be pushed substantially parallel with and away from the ice. In a third aspect of the present invention, only the shielding panel is provided with rotational flexibility such that the shielding panel (and its support struts in a supported assembly) will pivot about an axis located on top of or within the dasher board. In a fourth aspect of the present invention, only the shielding panel is provided with translational flexibility such that only the shielding panel (and its support struts) can be pushed substantially parallel with and away from the ice.

In particular, the first aspect of the present invention is a flexible dasher board assembly comprising a lower frame adapted to be anchored to the ground, an upper dasher board assembly located over the lower frame assembly comprising means for receiving a shielding panel, pivoting means for pivoting the upper dasher board assembly with respect to the lower frame when the upper dasher board assembly is subjected to a lateral force, and biasing means for biasing the upper dasher board assembly in an upright position when not subjected to a lateral force, the biasing means being compressible by the upper board assembly when subjected to a lateral force in order to allow the upper board assembly to pivot with respect to the lower frame.

The pivoting means comprises an elongated member extending substantially laterally along the upper board assembly whereby a pivoting surface or axis is formed between the elongated member and the lower frame assembly.

The flexible dasher board assembly also comprises means for restraining the upper dasher board assembly from disengaging from the lower frame when the upper dasher board assembly is subjected to a lateral force. The upper dasher board assembly comprises a lower channel extending laterally along its length, the lower channel comprising a slot along its lower surface disposed between a pair of laterally extending flanges. The restraining means comprises a hold down plate assembly, the hold down plate assembly comprising a hold down plate affixed to an upper surface of the lower frame so as to provide a pair of laterally extending gaps therebetween sufficient to captivate the flanges of the lower channel.

The biasing means comprises a spring and a bolt assembly comprising a locknut, the bolt assembly inserted through a retaining portion of the lower channel, the spring being captivated by the locknut and the retaining portion, the bolt assembly adapted such that a lower surface of the bolt is substantially in contact with the lower frame assembly, the spring tending to compress between the locknut and the retaining portion when a lateral force is imparted on the upper dasher board assembly, the spring tending to bias the upper dasher board assembly in an upright position when no lateral force is imparted on the upper dasher board assembly.

A flexible dasher board system is also provided, which includes a plurality of flexible dasher board assemblies interconnected to form an arena for playing a game. Each of the flexible dasher board assemblies is configured as described above. The system also comprises compressible bolt means for flexibly connecting adjacent pairs of flexible dasher board assemblies, each of the compressible bolt means tending to keep adjacent pairs of flexible dasher board assemblies in substantial alignment with each other in the absence of a later force on any of the flexible dasher board assemblies and allowing for movement of the flexible dasher board assemblies with respect to each other when subjected to a lateral force.

The flexible dasher board system also comprises a plurality of shielding panels, each of the shielding panels associated with one flexible dasher board assembly and captivated by the means for receiving a shielding panel, and a plurality of retaining clips, each of the clips configured to receive a top portion of a shielding panel, each of the clips removably attached to tops of adjacent pairs of shielding panels to flexibly align the shielding panels.

In the flexible dasher board system, the upper board assemblies each comprises a pair of vertical posts located at each end thereof, and the compressible bolt means each comprises a bolt and a pair of spring washers, the bolt inserted through the spring washers and a hole in a post of each adjacent upper board assembly and captivated with a nut, whereby the captivated adjacent posts are caused to be in substantial alignment with each other in the absence of a later force on any of the flexible dasher board assemblies and allow for movement of the flexible dasher board assemblies with respect to each other when subjected to a lateral force.

The second aspect of the present invention is a flexible dasher board assembly comprising a rear base portion adapted for mounting to a floor, a front board portion adapted for carrying a shielding panel, and means for slidingly mounting the front board portion with respect to the rear base portion, comprising biasing means for aligning the front board portion with the rear base portion, wherein the biasing means is adapted to allow the front board portion to slide towards the rear base portion when a lateral force is applied against the front board portion.

The front board portion comprises an upper sill extending laterally across the front board portion suitable for receiving a shielding panel, and the means for slidingly mounting the front board portion with respect to the rear base portion comprises a stringer extending laterally across the rear base portion, the upper sill resting on top of the stringer and capable of sliding across the stringer when a lateral force is applied against the front board portion.

The means for slidingly mounting the front board portion with respect to the rear base portion comprises a plurality of translational spring assemblies, each of the translational spring assemblies comprising a bolt/locknut combination connected between a first lug associated with the front board portion and a second lug associated with the rear base portion and captivating therebetween a biasing spring, the biasing springs tending to cause the front board portion to remain in predetermined juxtaposition with the rear base portion in the absence of a lateral force on the front board portion, and allowing the front board portion to slide towards the rear base portion when a lateral force is applied against the front board portion.

BRIEF DESCRIPTION OF THE DRAWING

FIGS. 1–5 illustrate side views of a traditional prior art dasher board and the various forces the boards are typically subjected to; wherein FIG. 1 illustrates a side view of a dasher board at rest;

FIG. 2 illustrates a side view of the rotational forces on the boards and shielding;

FIG. 3 illustrates a side view of translational forces on the boards and shielding;

FIG. 4 illustrates a side view of the rotational forces on the shielding relative to the boards;

FIG. 5 illustrates a side view of translational forces on the shielding relative to the boards;

FIGS. 6–11 illustrate side views of various aspects of the design concept of a first aspect of the present invention providing rotational flexibility of the dasher board assembly; wherein FIG. 6 illustrates the dasher board at rest;

FIG. 7 illustrates the rotational movement of the dasher board and shielding;

FIG. 8 illustrates a dasher board similar to FIG. 6;

FIG. 9 illustrates the rotational movement of the dasher board and shielding of FIG. 8;

FIG. 10 illustrates a dasher board similar to FIG. 6;

FIG. 11 illustrates the rotational movement of the dasher board of FIG. 10;

FIGS. 25–28 illustrate side views of various aspects of a design concept of a second aspect of the present invention which provides for translational flexibility, wherein FIG. 25 illustrates the dasher board at rest;

FIG. 26 illustrates the translational movement of the boards and shielding of FIG. 25;

FIG. 27 illustrates a dasher board similar to FIG. 25;

FIG. 28 illustrates the translational movement of the dasher board of FIG. 27;

DETAILED DESCRIPTION OF THE PREFERRED EMBODIMENT

1. Dasher Board Assembly with Rotational Flexibility

Figures 1, 2, 3, 4, 5:
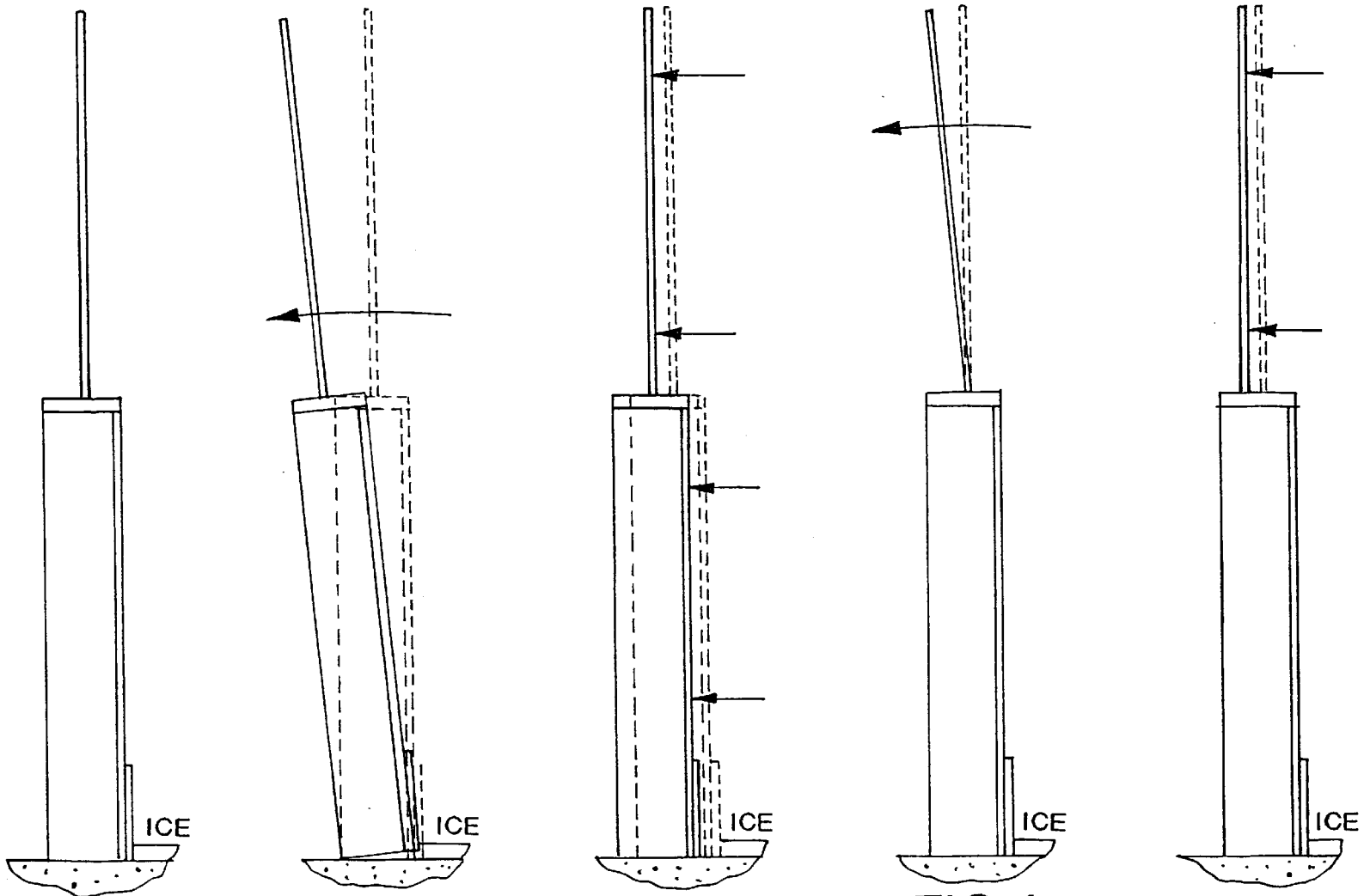
Figure 9:
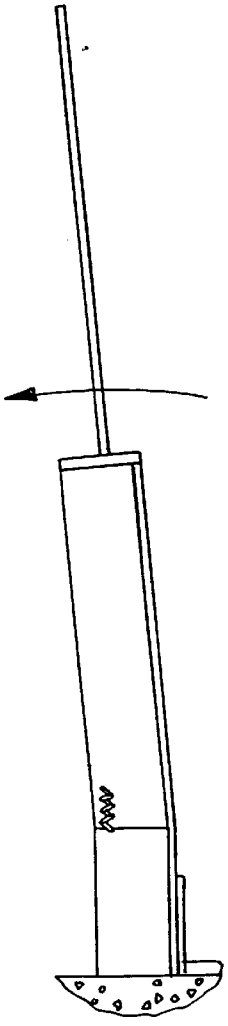
Figure 8:
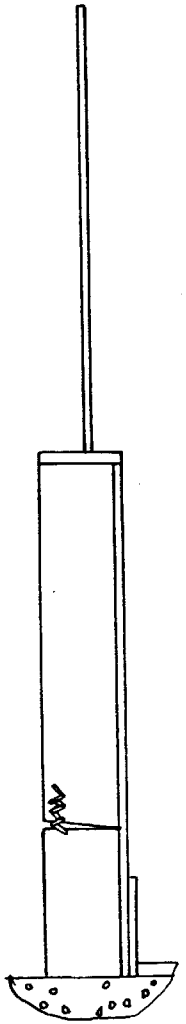
Figure 7:
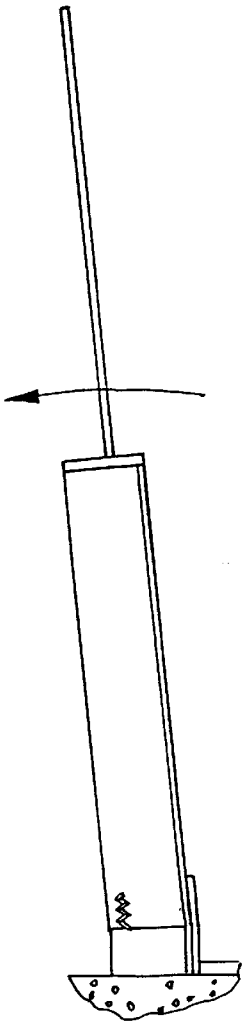
Figure 6:
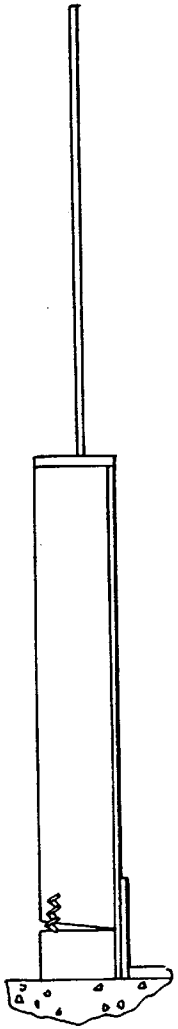
Figure 10:
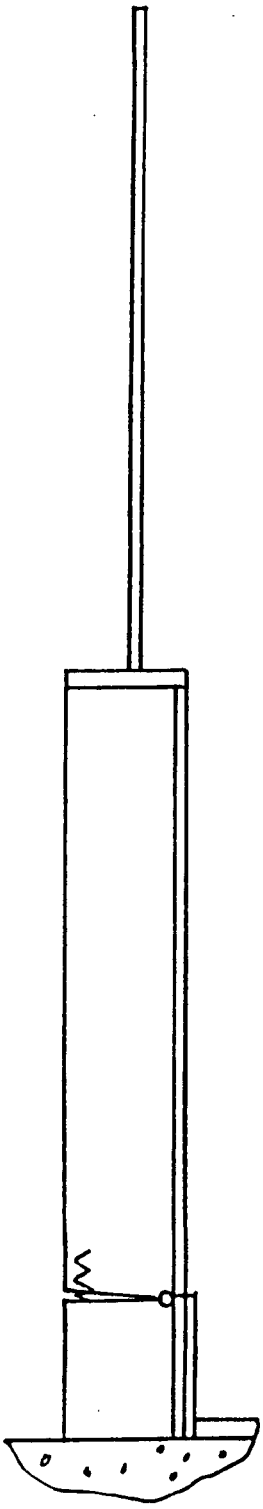
Figure 11:
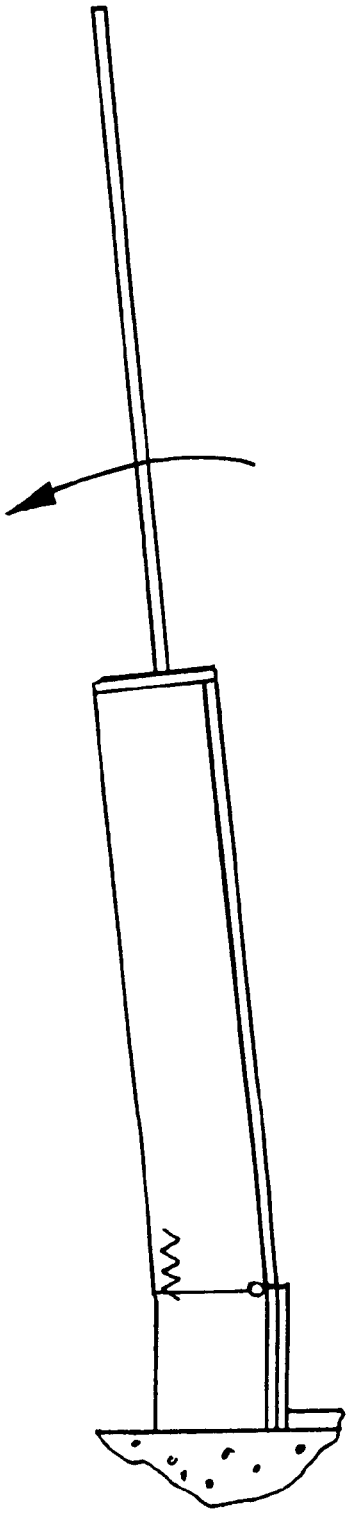

As shown in FIGS. 6–9, the concept of this first aspect of the present invention is shown, which is a solution to keeping the ice from creeping under the boards while providing rotational flexibility of substantially all of the dasher board. One way is to make the frame in two pieces each with its corresponding facing. The two frames would be connected by a pivot (or hinge as shown in FIGS. 10–11) and a spring element. The lower part would be rigid and fixed to the concrete. The upper part would be attached above the pivot and allowed to rotate away from the ice when hit as shown in FIG. 7. There would be a separation of the two pieces, which is hidden behind the kick strip.

A second solution to the prior art problem is to keep the facing in one piece and use it as the pivot. The frame would be made in two pieces with a spring element located near the base. The lower frame would be rigid and fixed to the concrete. The upper frame would be attached above the pivot and allowed to rotate away from the ice when hit. However, there would be no separation at the face of the boards because the facing is all one piece and bends as needed. In each case the spring element is adjustable and a limit (or stop) provided to control the amount of movement.

Figure 12:
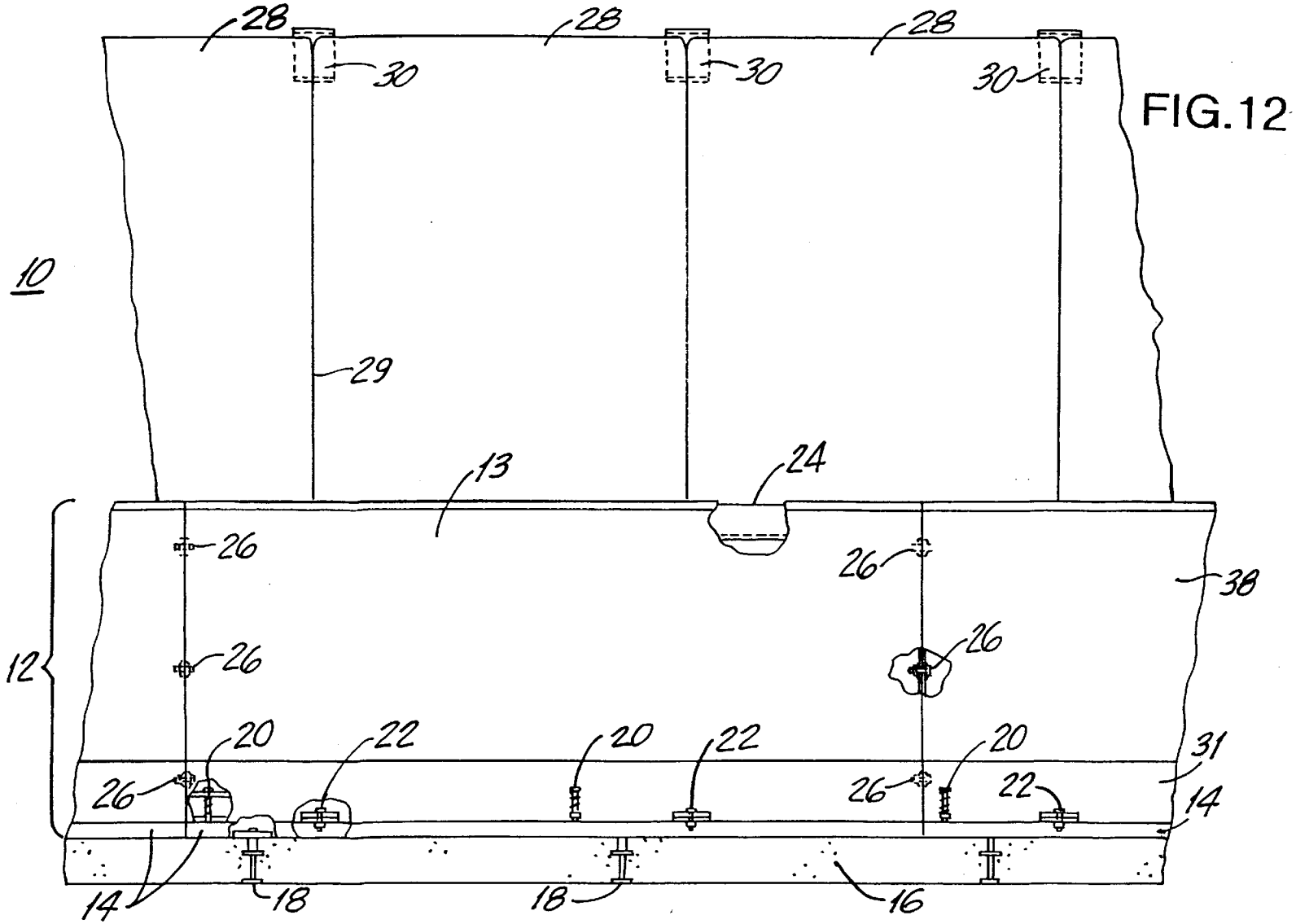
FIG. 12 illustrates the main components of a preferred embodiment dasher board system in accordance with the first aspect of the present invention that offers rotational flexibility.

FIG. 12 illustrates the preferred embodiment flexible dasher board system 10 in accordance with the first aspect of the present invention. The system 10 comprises a series of dasher board assemblies 12 flexibly connected to each other, in end-to-end fashion, to form a rink such as a hockey rink. Each of the dasher board assemblies 12 comprises a U-channel assembly 24, into which an associated shielding panel 28 is removably inserted. This type of system, known generally as a supportless dasher board system, is disclosed in U.S. Pat. No. 5,706,625, which is owned by the assignee of the present invention. As explained in the '625 patent, the shielding panels 28 are inserted into the U-channel assembly 24 of the dasher board assembly 12, and a cam assembly (not shown) is used to pinch the U-channel assembly around the shielding panel 28 and against a stationary portion of the dasher board assembly 12, thus pinching the shielding panel 28 into place. This type of assembly does not require the use of support members extending vertically along the edges 29 of the panel 28, which were formerly used in the prior art to hold the shielding panels in place.

A retaining clip 30 is used to retain adjacent panels 28 in close relation to each other, in particular near the top portions of the panels. Since vertical support members are not used in this embodiment, the use of the clips 30 aid in keeping the adjacent panels 28 aligned with each other. The clips 30 are designed to provide a desired degree of resilience and flexibility, such that the top portions of the panels 28 are able to move in relation to each other in accordance with the present invention. The clips 30 are described in further detail below.

Each dasher board assembly 12 comprises several major components to be described herein, which operate in conjunction with each other to provide the advantageous flexibility of the present invention. Each dasher board assembly comprises an upper board assembly 13 that is located on top of an ice retainer 14, which is covered by facing 38 and a kick strip 31. The upper board assembly 13 is flexibly joined to the ice retainer 14 by a series of biasing assemblies 20 and hold down assemblies 22, which although independent from each other, act in concert to keep the upper board assembly 13 aligned directly over the ice retainer 14 and prevent it from being pushed off the ice retainer 14 when hit by a player, yet provide a desired degree of flexibility or play and return the upper board assembly 13 to its quiescent position over the ice retainer 14 after the player has left contact with the upper board assembly 13 (or panel 28).

Also aiding in providing the desired flexibility and stability to the system 10 are a series of compressible connecting bolt assemblies 26, also shown in cutaway of FIG. 12. These bolt assemblies 26 maintain the ends of the dasher board assemblies 12 in close relation to each other when in a quiescent state, yet allow the dasher board assemblies 12 to move in relation to each other when a force is exerted by a player. The bolt assemblies 26 are also described in detail below.

The entire flexible dasher board system 10 is held in place by a series of anchors 18, which maintain the ice retainers 14 in secure, fixed position in the concrete floor 16. The ice retainers 14 thus remain fixed at all times, with the upper board assemblies 13 being allowed to rotate with respect to the ice retainer 14 when a force is exerted by a player at any point along the upper board assembly 13 or panel 28.

Figure 13:
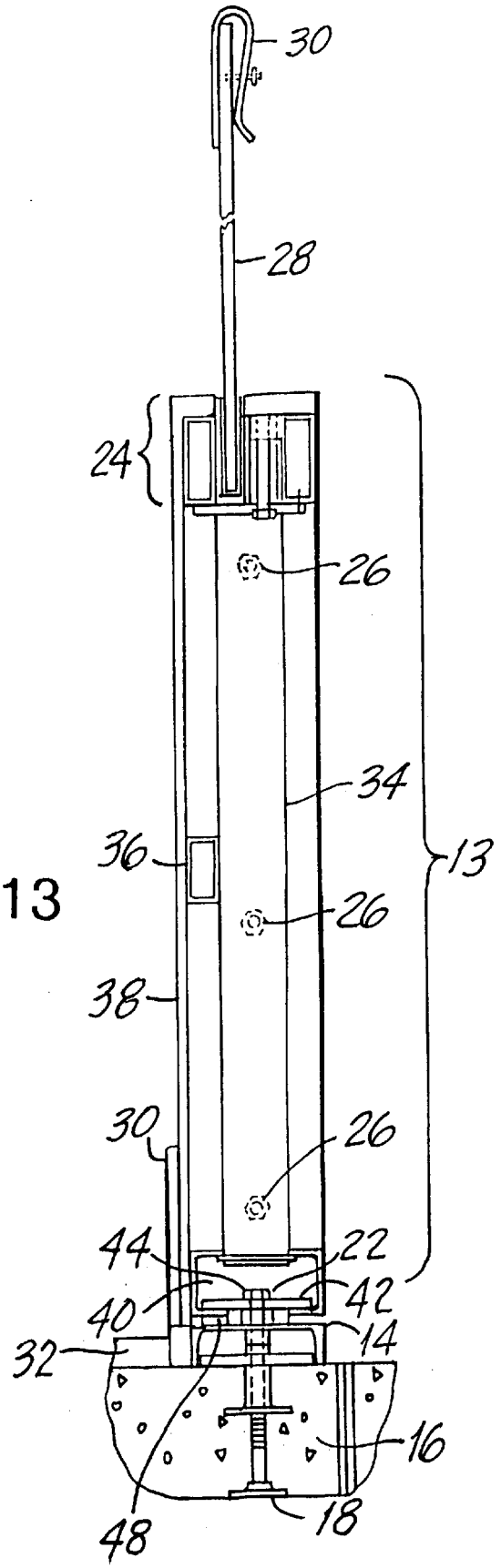
FIG. 13 shows a first side cross sectional view of the dasher board assembly of FIG. 12.
Figure 14A:
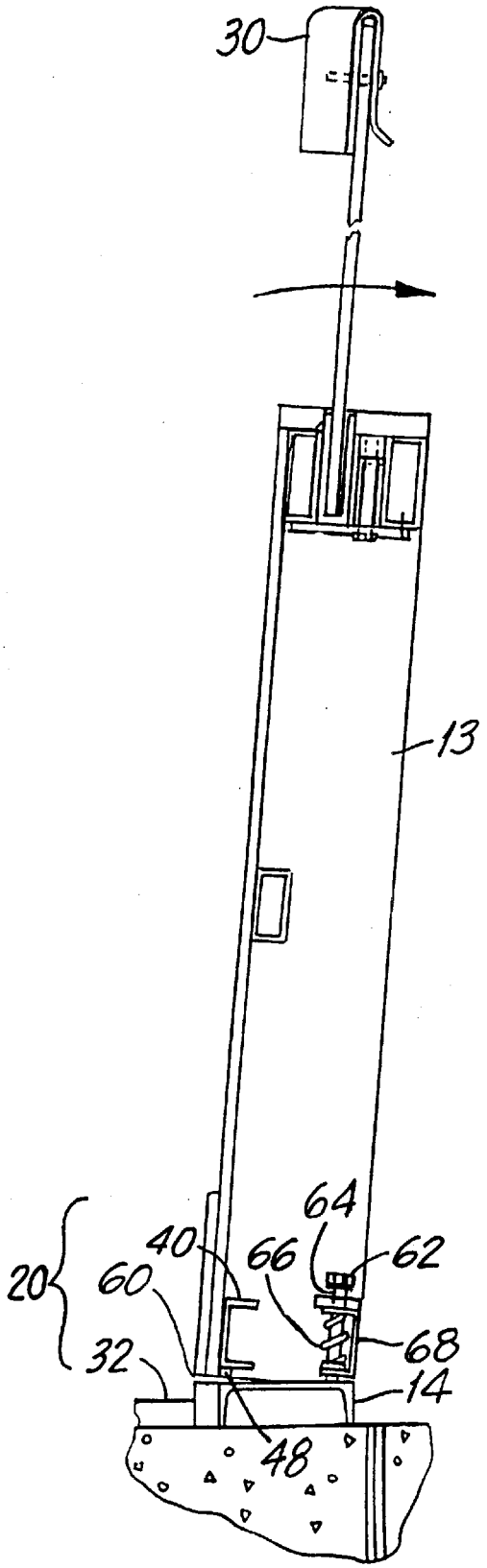
FIGS. 14A and 14B show a second cross sectional view of the dasher board assembly of FIG. 12.
Figure 14B:
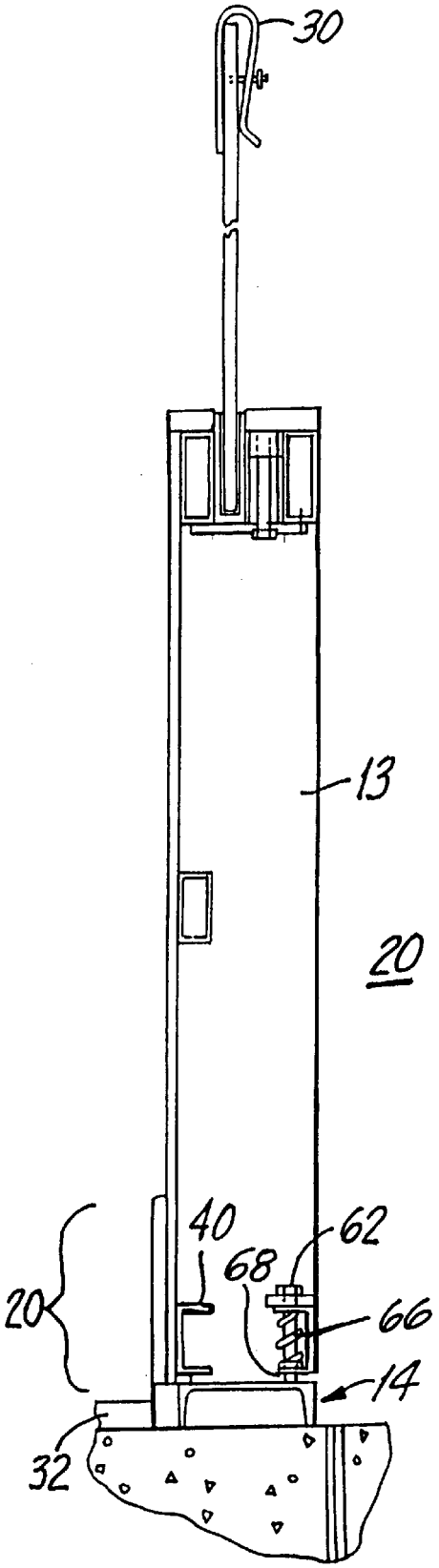

FIG. 13 is a side, cross section illustration of the dasher board system 10 of FIG. 12, showing in particular the operation of the hold down assembly 22. The upper board assembly 13 comprises a series of vertical posts 34, each of which are joined to the top portion of a laterally-running channel 40. Stringers 36 extend laterally along the posts 34. The U-channel assembly 24, described in detail in U.S. Pat. No. 5,706,625, also extends laterally on top of the posts 34 to provide removable support for the panels 28. The facing 38 is mounted to the front portions of the channel 40, the stringer 36, and the U-channel assembly 24, thus providing the outer surface that is visible to the observer and that is contacted by the player. Also shown in FIG. 13 are the compressible connecting bolt assemblies 26, which join adjacent dasher board assemblies 12 with each other in flexible fashion.

Figure 18A:
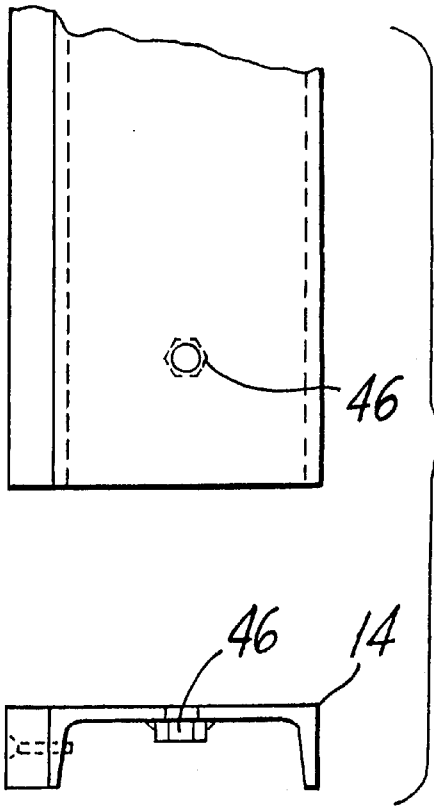
FIGS. 18A and 18B show views of the ice retainer used in the dasher board assembly of FIG. 12.
Figure 18B:
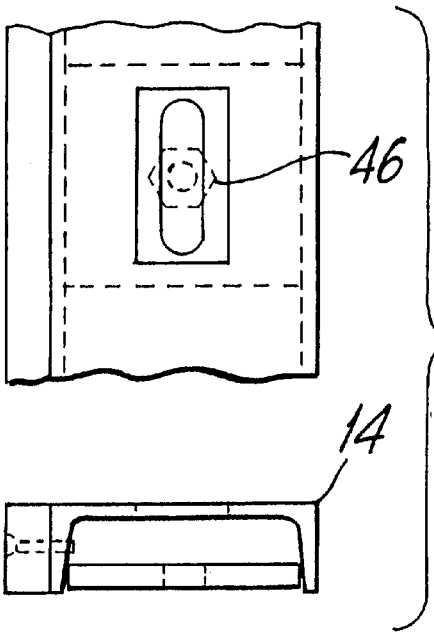
Figure 19A:
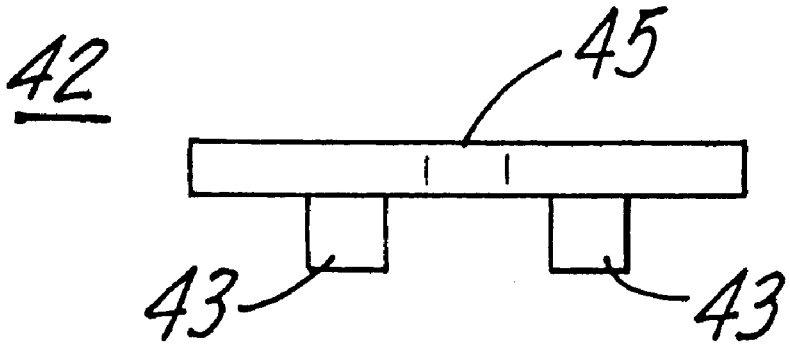
FIGS. 19A and 19B show views of the hold down plate used in the dasher board assembly of FIG. 12.
Figure 19B:
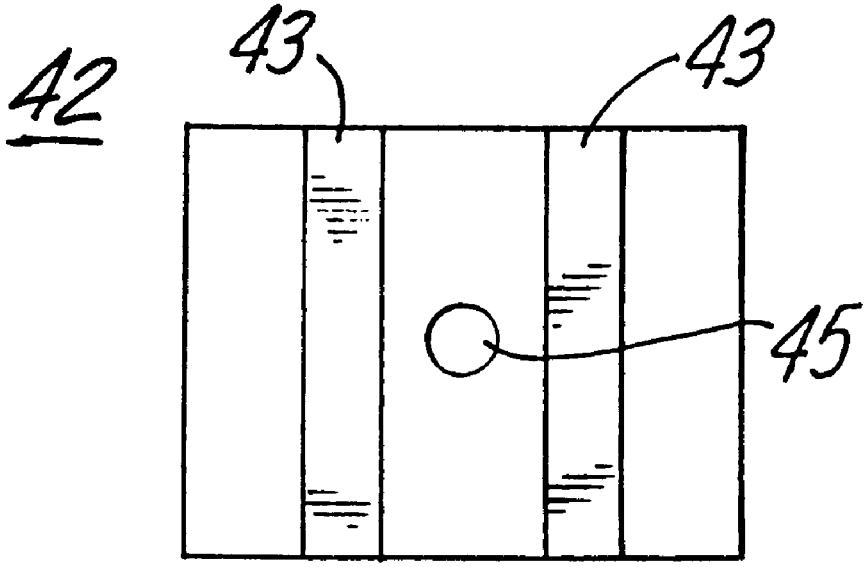

The hold down assembly 22 is now described in detail, with respect to FIGS. 13, 16A, 16B, 17A and 17B. The ice retainer 14 is fixedly joined to the concrete floor 16 by a series of anchors 18. The hold down plate 42, which is shown in detail in FIGS. 19A and 19B, is a rectangular steel plate with a hole 45 in the center. A pair of steel bars 43 are welded to the steel plate as shown, thus providing the cross section as shown in FIG. 19A. As shown in close-up in FIGS. 17A and 17B, the hold down plate 42 is joined to the top of the ice retainer 14 by a bolt 44 and an associated nut 46 (which may be welded to the bottom of the ice retainer 14 as shown in FIG. 18A). In particular, the bars 43 make contact with the top of the ice retainer 14 and the bolt 44 is inserted through the hole 45 and a second hole in the ice retainer to be joined with the nut 46.

Figure 17B:
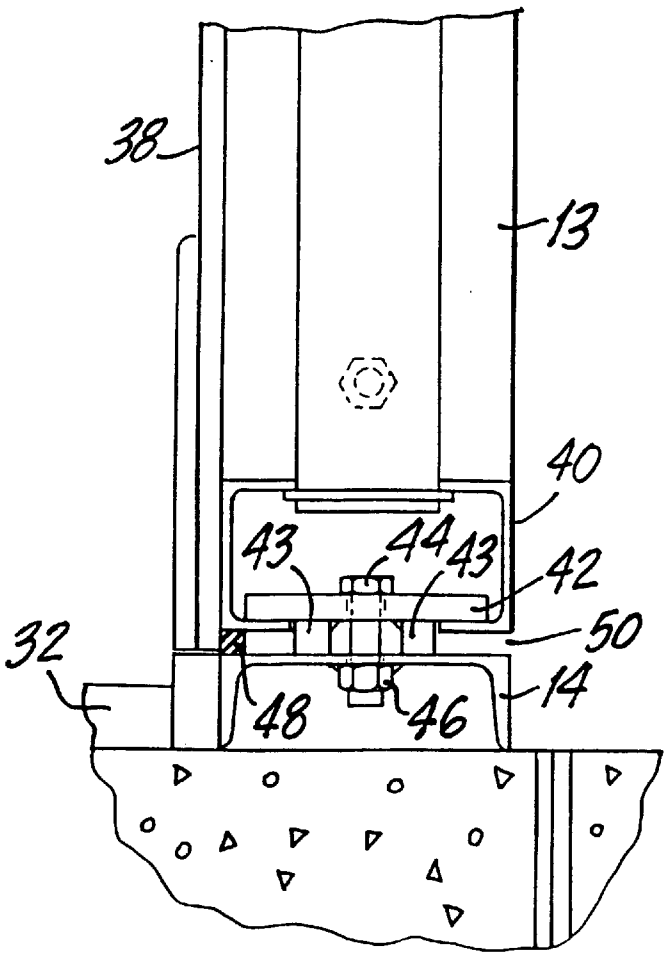
FIGS. 17A and 17B are close-up views of FIGS. 16A and 16B, respectively.
Figure 17A:
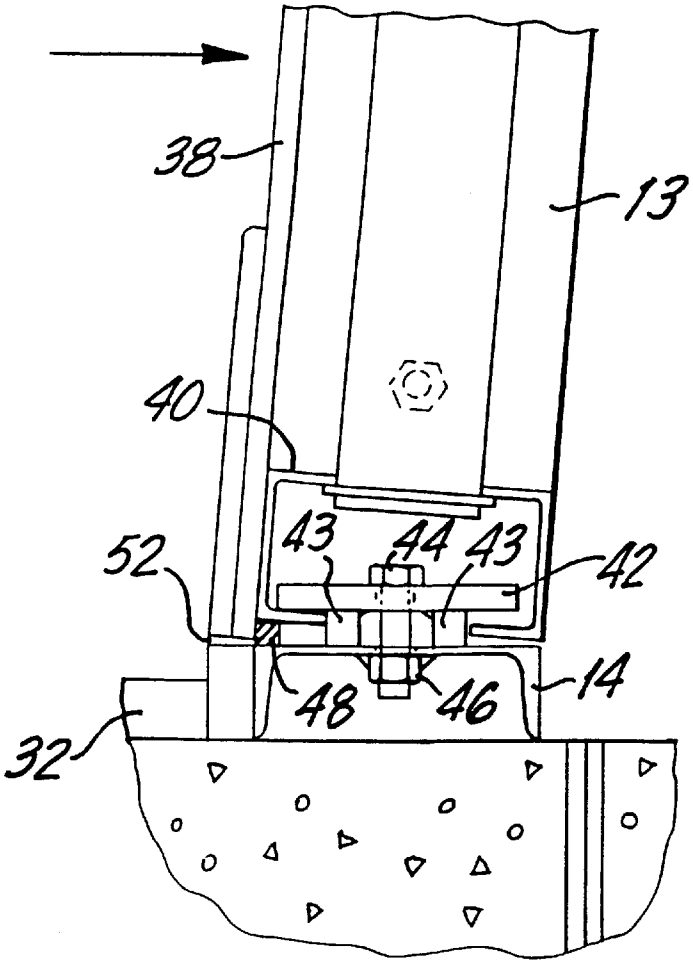

Prior to fixing the hold down plate 42 to. the ice retainer 14, the channel 40 is placed along the top of the ice retainer as shown in FIGS. 17A and 17B. The channel 40 is configured so that it can be slid along the length of the ice retainer 14 while the hold down plate 42 is already fixed in place, or the hold down plate 42 may be joined to the ice retainer 14 after the channel 40 is put into place. In either case, the resulting assembly in shown in FIGS. 17A and 17B.

A pivot member 48 is joined to the channel 40 as shown in FIGS. 17A and 17B. The pivot member 48 extends laterally, substantially along the length of the channel 40, to provide a support plane on the ice side 32 of the assembly. As shown in FIG. 17B, a gap 50 exists between the bottom of the channel 40 and the top of the ice retainer 14 on the non-ice side of the assembly. The dasher board assembly is shown in FIG. 17B in an upright position, which is held there by the biasing assemblies 20 as described in detail below.

Thus, when a force is applied to the facing 38 as shown by the arrow in FIG. 17A, the upper board assembly 13 will tilt away from the ice 32 by pivoting about the axis defined by the line that adjoins the rear of the pivot member 48 and the top of the ice retainer 14. This pivoting motion is enabled by the gap 50 on the non-ice side of the assembly. As can be seen, by positioning the pivot line on the ice side of the dasher board assembly, only a minimal gap 52 is created near the ice. This minimal gap 52 is located above the ice line in this aspect of the invention, and is preferably covered by a kick strip 30 (not shown in FIG. 17A). This is advantageous over the prior art, which provides for a pivot at the non-ice side of the assembly, thus requiring a large gap to open when the boards are contacted by a player, and allowing ice to deleteriously creep into the large gap.

Several hold down assemblies 22 may be strategically located along the length of the dasher board assembly 12, as shown in FIG. 12, in order to provide for the upper board assembly 13 to be movably secured to the ice retainer 14. That is, since the biasing assemblies 20 do not provide any means of securing the upper board assembly 13 to the ice retainer 14, all means of keeping the upper board assembly 13 from flying off the ice retainer 14 when contacted by a player are provided by the hold down assemblies 22.

The dasher board assembly is held in an upright position, as shown in FIG. 17B, by the biasing assemblies 20, which are strategically located along the length of the dasher board assembly 12. Notably, the biasing assemblies 20 and the hold down assemblies 22 are separate assemblies and do not depend on each other to perform their respective functions. Although they are separate assemblies, they operate in concert with each other to provide the required biasing and hold down functions.

Figure 20A:
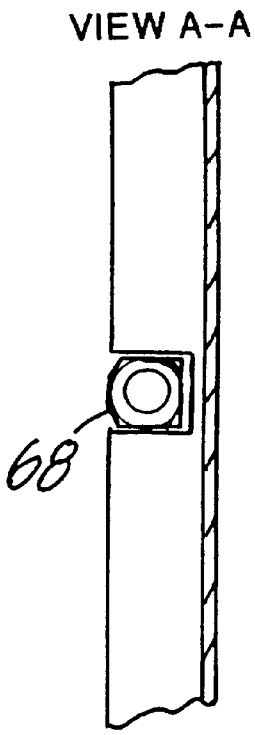
FIGS. 20, 20A, and 20B show the tension spring and associated components used in the dasher board assembly of FIG. 12.
Figure 20B:
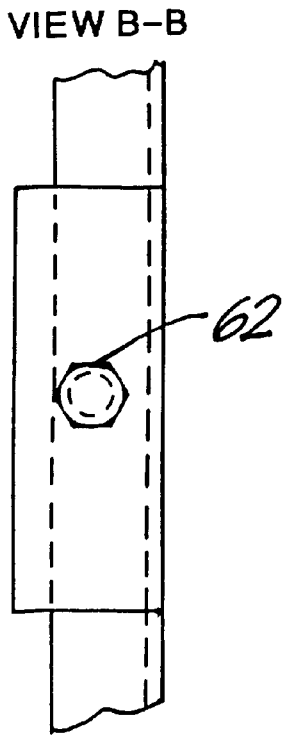
Figure 20:
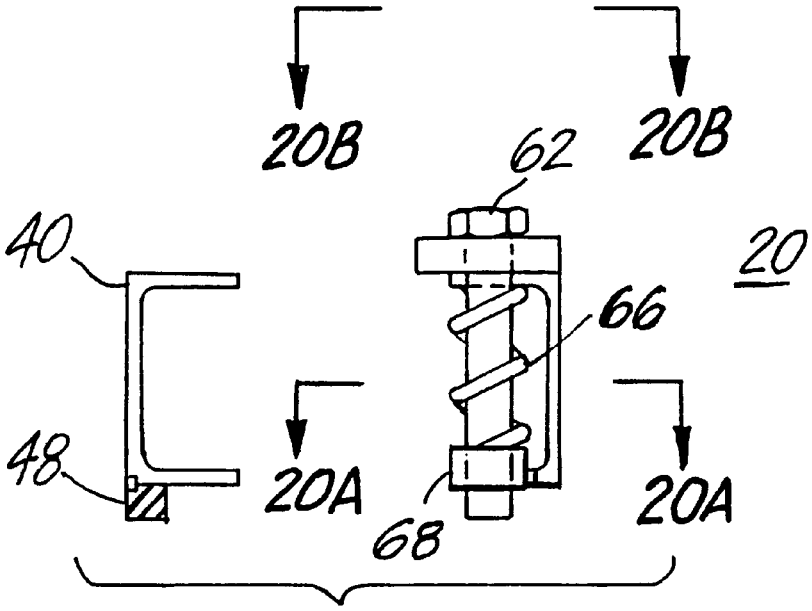

FIGS. 14A, 14B, 15A, and 15B illustrate the biasing assembly 20, which comprises a spring 66, a bolt 62, and a locking nut 68 assembled together around an opening in a retaining portion 70. As shown in FIGS. 20, 20A,and 20B, the locking nut 68 is held in place, and prevented from turning, by the retaining portion 70. Thus, when the bolt is rotated, the locking nut is held in place, and the spring 66 will compress or decompress to vary the amount of bias in the assembly 20.

Figure 15B:
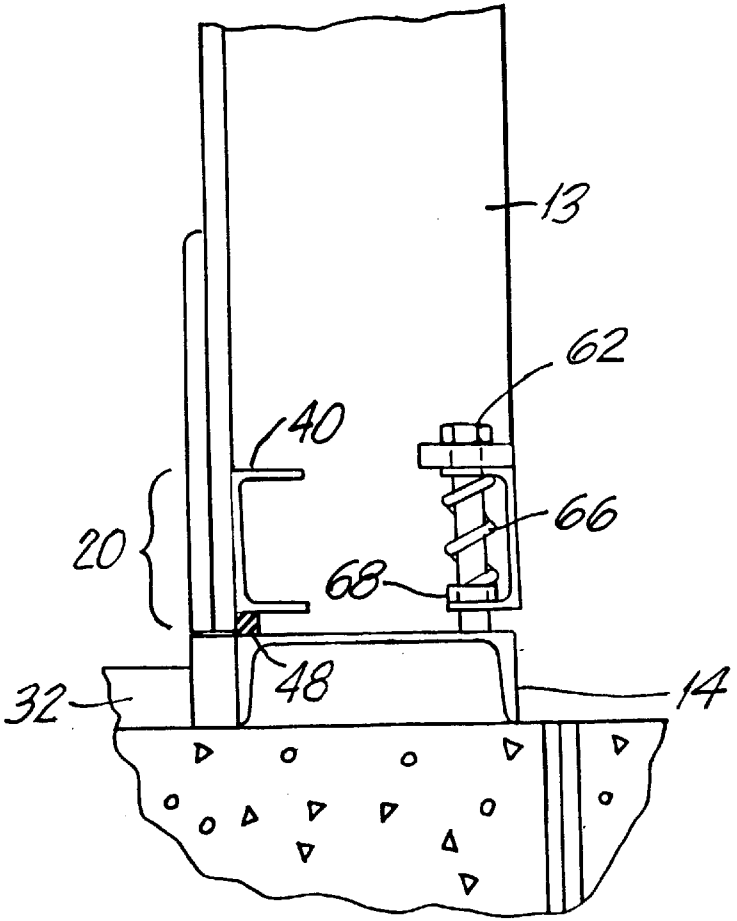
FIGS. 15A and 15B are close-up views of FIGS. 14A and 14B, respectively.
Figure 15A:
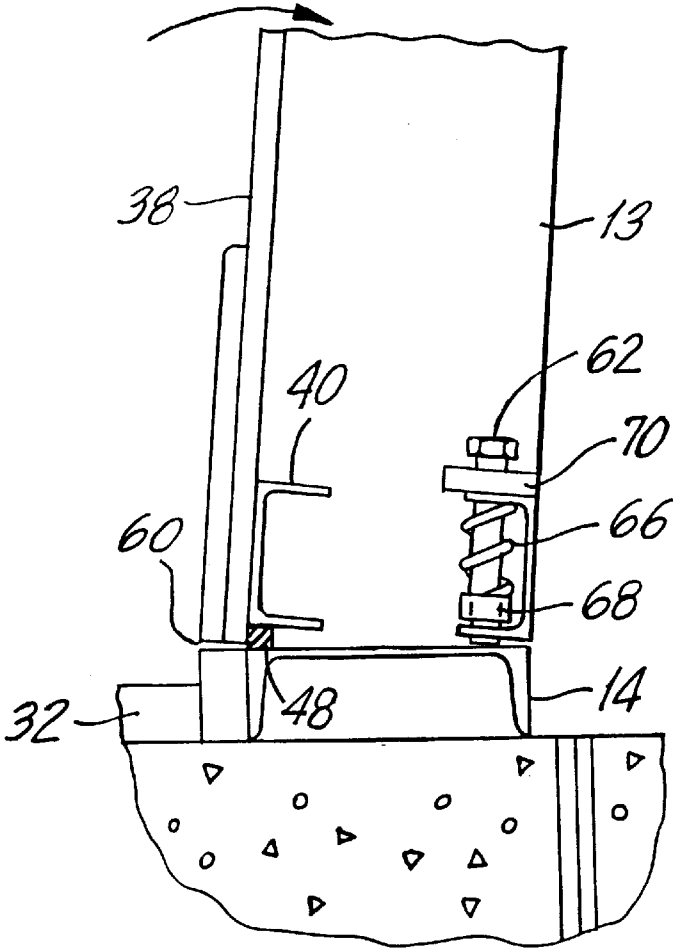
Figure 16A:
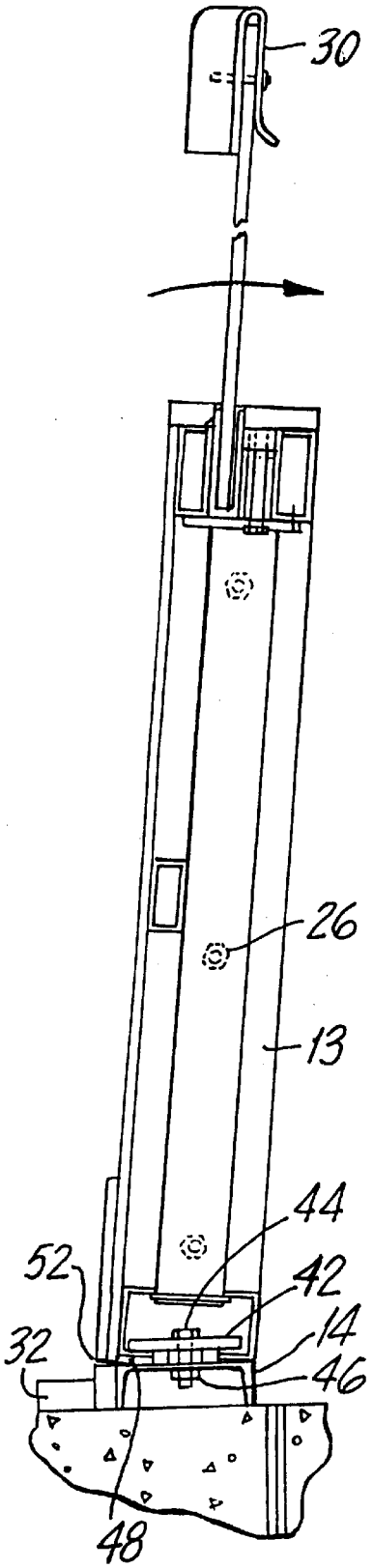
FIGS. 16A and 16B show a third cross sectional view of the dasher board assembly of FIG. 12.
Figure 16B:
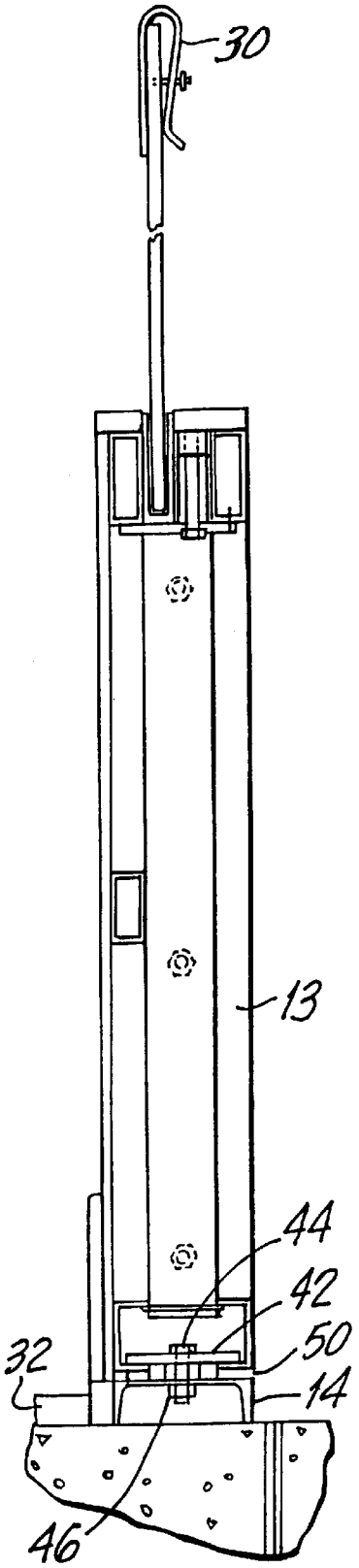

As shown in FIG. 15B, the bottom portion of the bolt 62 rests on top of the ice retainer 14 when no force is exerted against the facing 38. When, however, a force is exerted against the facing by a player, as shown by the arrow in FIG. 15A, the upper board assembly 13 will be directed away from the ice 32, pivoting on the pivot member 48, and the spring 66 will compress between the locking nut 68 and the retaining portion 70. As such, the spring 66 will tend to bias the assembly back towards its normal, upright state. When the force is removed (the player skates away), then the spring 66 tends to cause the assembly to return to its upright position. The tension exerted by the spring 66 can be adjusted as desired, simply by loosening or tightening the bolt 62 while the locking nut 68 remains in place.

Figure 21C:
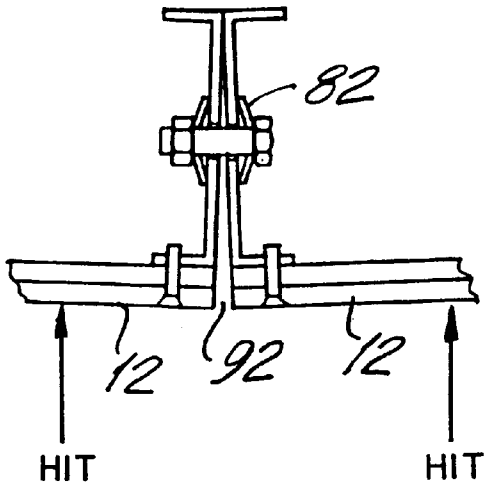
FIGS. 21A, 21B, and 21C show the compressible connecting bolt assembly used in the dasher board assembly of FIG. 12.
Figure 21B:
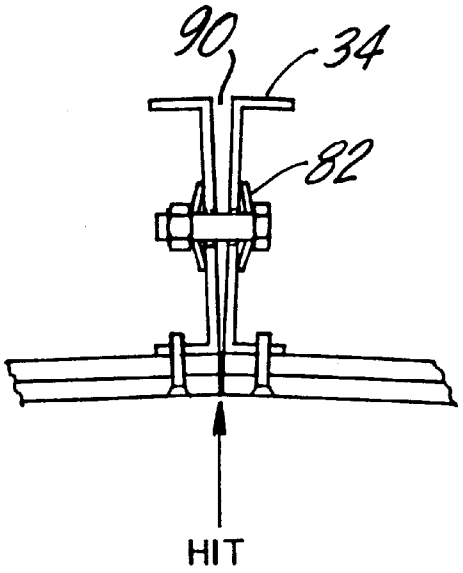
Figure 21A:
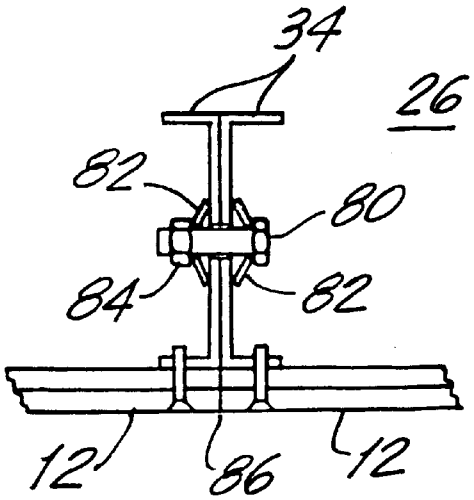

FIGS. 21A, 21B, and 21C illustrate a top cross-section view of the compressible connecting bolt assembly 26 in detail. Each bolt assembly 26 comprises a bolt 80 that is inserted through a spring washer 82, a hole in the post 34 of a first dasher board assembly 12, a corresponding hole in the post 34 of an adjoining dasher board assembly, and a second spring washer 82. A nut 84 is then threaded onto the bolt for captivating this assembly. The amount of resiliency that will be provided by the assembly 26 is determined by the amount of torque imparted on the nut 84 (and of course on the characteristics of the spring washers 82).

FIG. 21A illustrates the bolt assembly 26 in its quiescent state, wherein pairs of adjoining dasher board assemblies 12 are aligned with each other as desired. The illustration of FIG. 21A shows the alignment as substantially linear, which will occur along those portions of the entire rink that are straight. In the corners, however, where curved dasher board assemblies are used, the area around the joint 86 will provide a correspondingly curved surface.

FIG. 21B illustrates the flexing action of the compressible connecting bolt assembly 26 upon being subjected with a direct hit on the joint 86 by a player. When this type of hit occurs, the joint is caused to move away from the ice, causing the rear portions of the spring washers 82 to expand away from each other, and also causes the front portions of the spring washers 82 to expand away from each other (by a smaller amount). A gap 90 is formed as a result of this action. When the force exerted by the player is removed, the biasing action of the spring washers 82 causes the bolt assembly 26 to return to its quiescent (unbiased) state.

Likewise, FIG. 21B illustrates the flexing action of the compressible connecting bolt assembly 26 upon being subjected with a hit by a player on the dasher board assembly 12, on either side (or both sides) of the joint 86. When this type of hit occurs, the dasher board assembly 12 is caused to move away from the ice, causing the front portions of the spring washers 82 to expand away from each other, and also causes the rear portions of the spring washers 82 to expand away from each other (by a smaller amount). A gap 92 is formed as a result of this action. When the force exerted by the player is removed, the biasing action of the spring washers 82 causes the bolt assembly 26 to return to its quiescent (unbiased) state.

As shown in FIG. 12, a clip 30 is used to hold in place adjoining pairs of shielding panels 28. The clip 30 is flexible so as to allow the panels 28 to move in relation to each other when a force is exerted on the boards 12 or panels 28 by a player, yet maintains its original shape so as to aid in returning the panels to their normal aligned state after the force is removed.

Figure 22B:
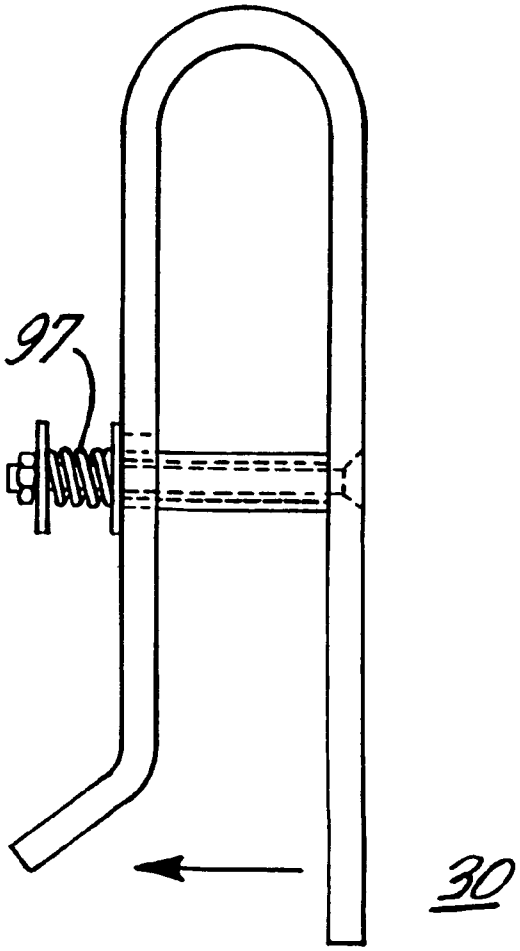
FIGS. 22A and 22B show the retaining clip used in the dasher board assembly of FIG. 12.
Figure 22A:
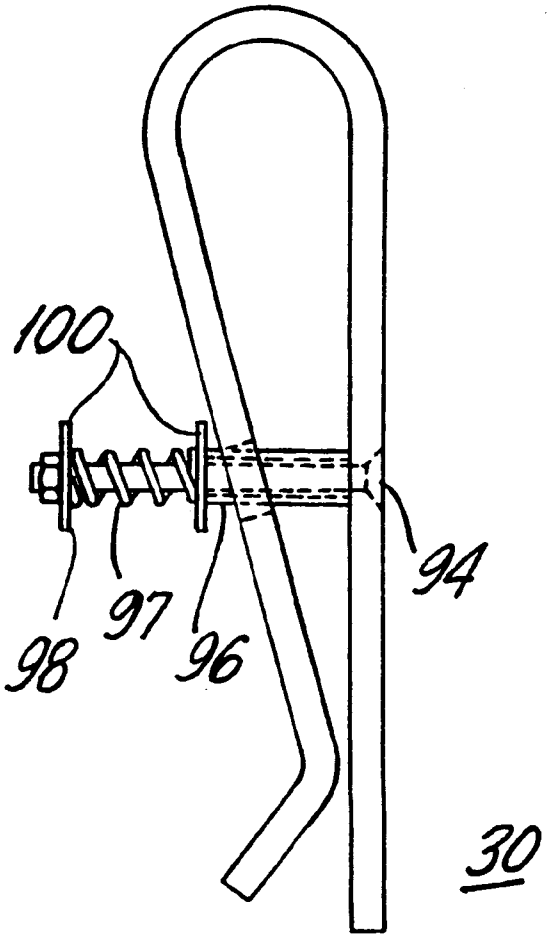

FIGS. 22A and 22B illustrate a side view of the clip 30. The clip 30 is fabricated from a piece of plastic such as LEXAN that is about 5½" wide by 13½" long, and is shaped by conventional means to form the clip 30 as shown in a hairpin-like cross-section. After shaping, the length of the clip 30 is about 6¼". The clip 30 is assembled onto an adjacent pair of panels by using the bolt 94, the sleeve 96, the compression spring 97, the washer 98, and the nut 100 as shown. FIG. 22B illustrates the resiliency of the clip 30, which can open as shown when a force is exerted as indicated by the arrow. The compression spring 97 aids in biasing the clip back to its quiescent state of FIG. 22A after the force is removed. The sleeve or tube 96 keeps the glass panels from touching the steel bolt so that chipping of the glass is avoided.

Figure 23A:
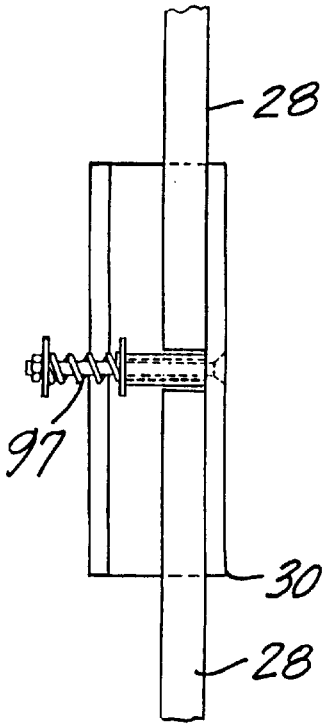
FIGS. 23A, 23B, 23C, and 23D show the operation of the clip of FIG. 22A.
Figure 23B:
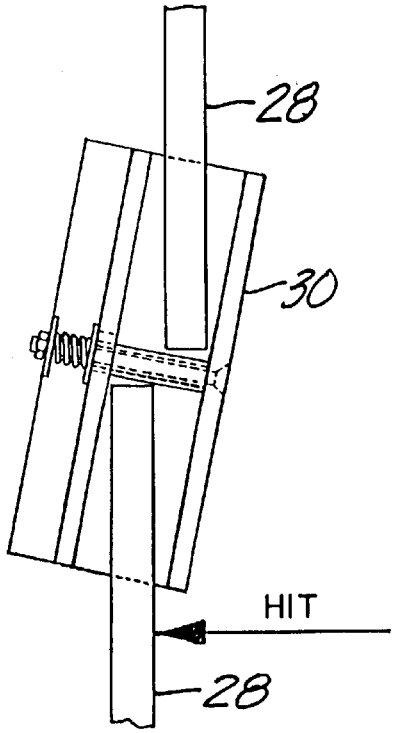
Figure 23C:
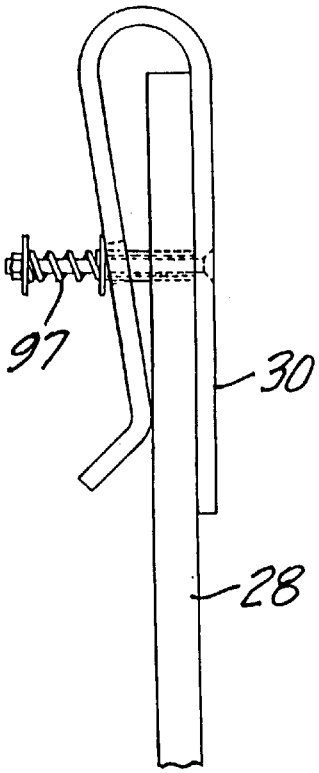
Figure 23D:
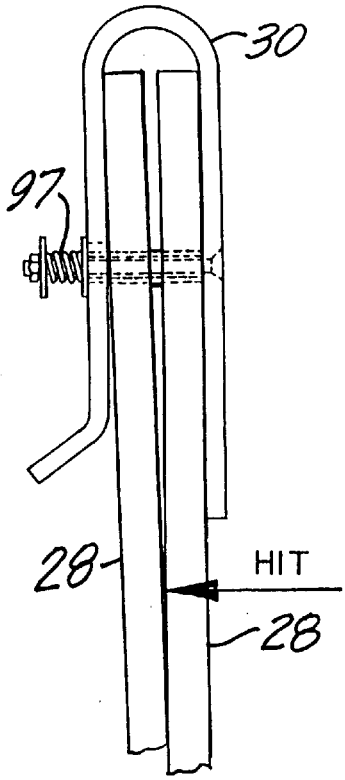

The clip will thus expand when a force is imparted on a shielding panel 28 as shown in FIG. 23A, 23B, 23C, and 23D. FIGS. 23A and 23B show a top view of a pair of panels 28 being spread apart from each other due to a force as indicated by the arrow. The clip will expand accordingly to allow the panels 28 to temporarily shift, thus providing a shock-absorbing effect. FIGS. 23C and 23D illustrate this same principle from a side view.

In addition, the steel bolt and clear flexible sleeve 96 may be replaced by a nylon bolt, which will help prevent damage to the glass.

Thus, by providing the dasher board system as described above, the biasing assemblies 20, the hold down assemblies 22, the compressible connecting bolt assemblies 26, and the clips 30 all act independently, yet in concert, to provide the desired flexibility and shock absorbing characteristics.

FIGS. 24A, 24B, 24C, and 24D illustrate an alternative embodiment of the first aspect of the present invention. This embodiment operates on the same principle as the preferred embodiment discussed above; which is the use of a pivot axis located near the front (ice side) of the dasher board assembly so that little or no gap is created at the front when the dasher board assembly is struck by a player and caused to flex as shown by the arrow in FIG. 24B. Thus, this embodiment utilizes a pivot or hinged axis 122, that is covered by a kick strip or facing 120, to provide the rotational flexibility. The cross-sectional profile of the upper board assembly 13 is such that an angular gap 126 is formed between it and the ice retainer 124, which is fixed to the concrete surface by anchors 118. In particular, the anchor 118 is inserted through a plate 116, which is urged against the bottom of channel 114 to cause the ice retainer 124 to be fixed with respect to the concrete floor. A bolt 112 is inserted through a portion of the upper board assembly 13, a spring 110, and a portion of the ice retainer 124, as shown in the Figures. In addition, tensioning nuts are provided so the amount of bias can be adjusted as desired. As a result of this configuration, the upper board assembly is supported over the ice retainer, and the spring 110 provides adequate bias so as to keep the assembly aligned as desired.

Figure 24A:
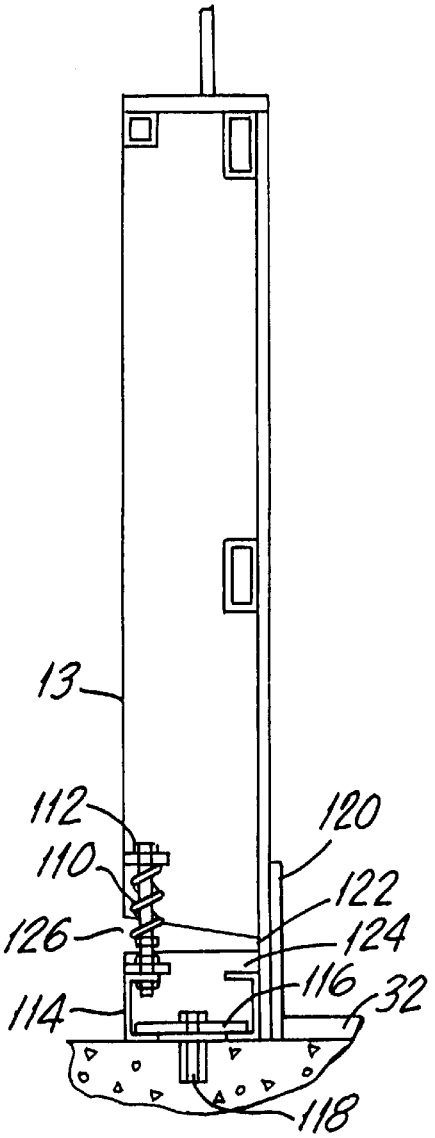
FIGS. 24A, 24B, 24C, and 24D show an alternative embodiment dasher board system providing rotational movement.
Figure 24B:
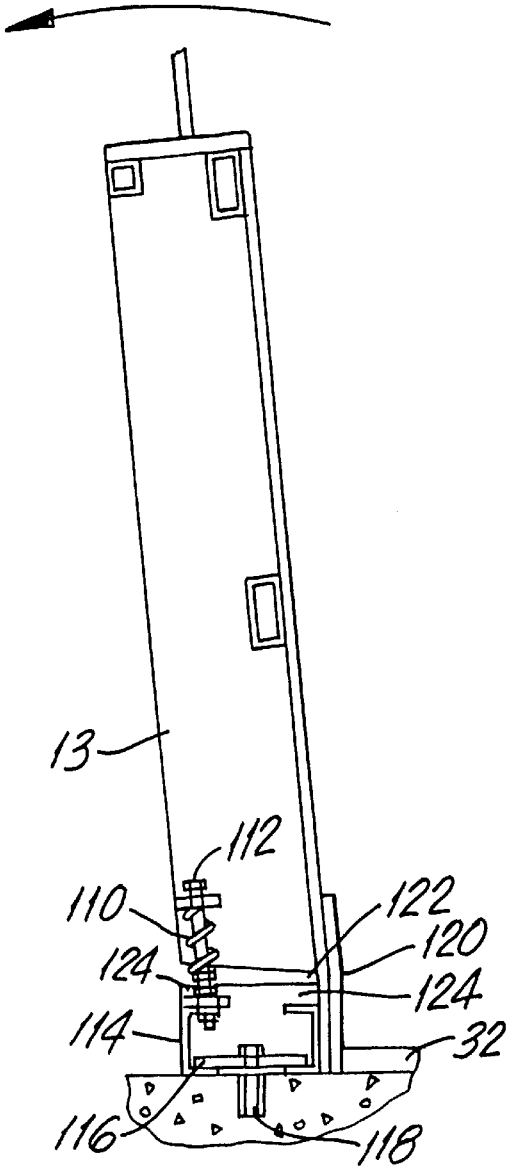

When a player contacts the upper board assembly 13 so as to cause a force in the direction of the arrow in FIG. 24B, the spring is compressed and the upper board assembly 13 is caused to rotate around the pivot axis 122 away from the ice. Once the force is removed, the biasing action of the spring 110 returns the upper board assembly 13 to its normal position as in FIG. 24A.

Figure 24C:
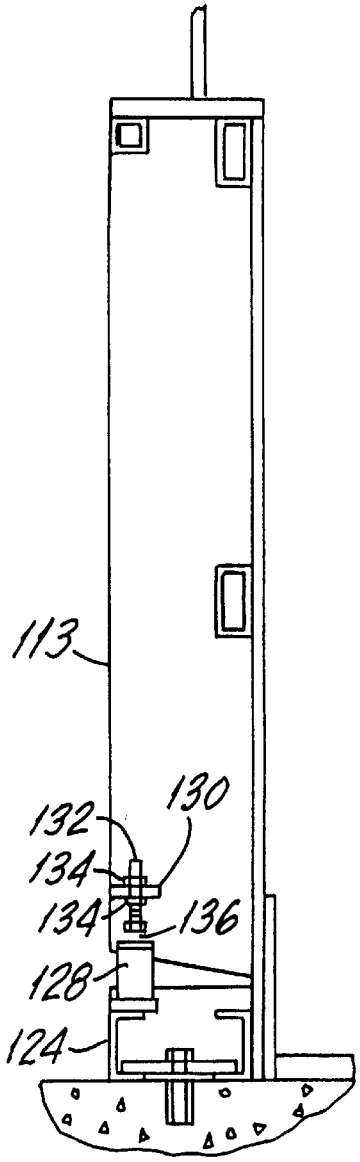
Figure 24D:
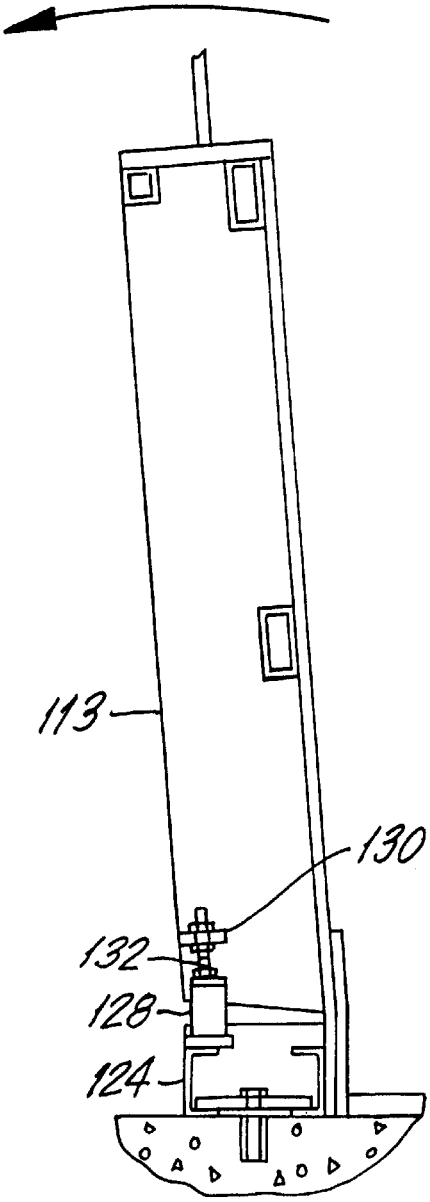

In order to control the flexing action of the upper board assembly 13, an adjustable stop mechanism is provided as shown in FIGS. 24C and 24D, which is a cross section taken at a different lateral location of the board assembly. The upper board assembly 13 comprises a lug 130 affixed as shown in the Figures, into which a bolt 132 is captivated by a pair of nuts 134. The position of the head of the bolt 132 can be adjusted with the nuts 134, so that a gap 136 is created as desired. A stop block 128 is affixed to the ice retainer 124 as shown. When the upper board assembly 13 is caused to rotate with respect to the ice retainer 124, the head of the bolt 132 will strike the top surface of the stop block 128 and be prohibited from moving further, as shown in FIG. 24D. When the force applied on the boards is removed, the spring 110 will cause the assembly to return to its normal upright position.

2. Dasher Board Assembly with Translational Flexibility

Figure 28:
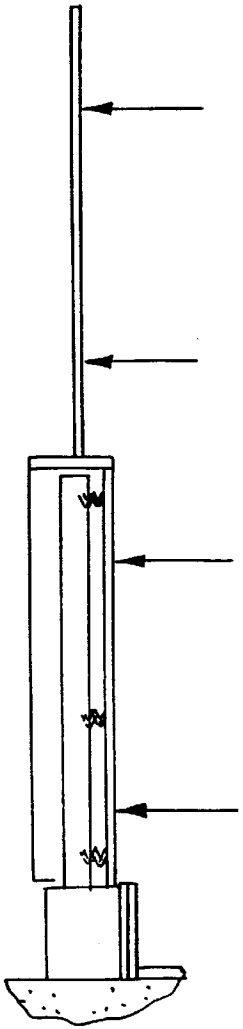
Figure 27:
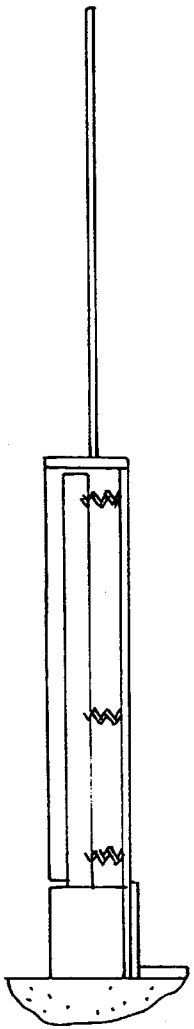
Figure 26:
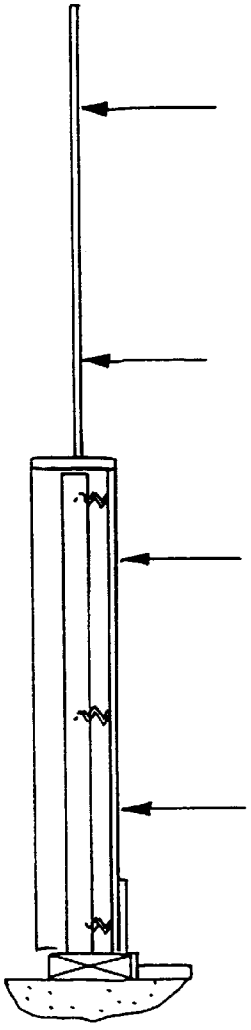
Figure 25:
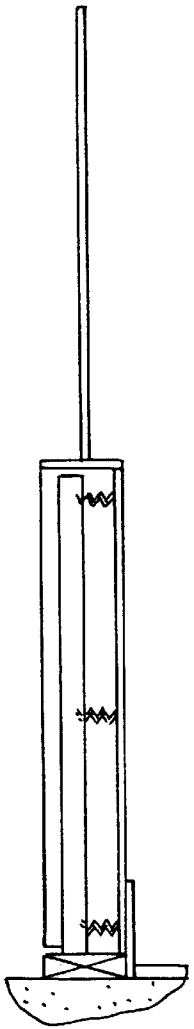

FIGS. 25–28 illustrate side views of various aspects of the design concept of the second aspect of the present invention which provides for translational flexibility. FIG. 25 illustrates a dasher board provided with biasing springs that would compress to allow translational movement of the entire board assembly when subjected with a lateral force. FIG. 26 illustrates the translational movement of the boards and shielding of FIG. 25 when subjected with a force as shown by the arrows. The springs compress, and allow the board assembly to move away from the ice, thus absorbing the shock. FIG. 27 illustrates a dasher board similar to FIG. 25; FIG. 28 illustrates the translational movement of the dasher board of FIG. 27.

Figure 29:
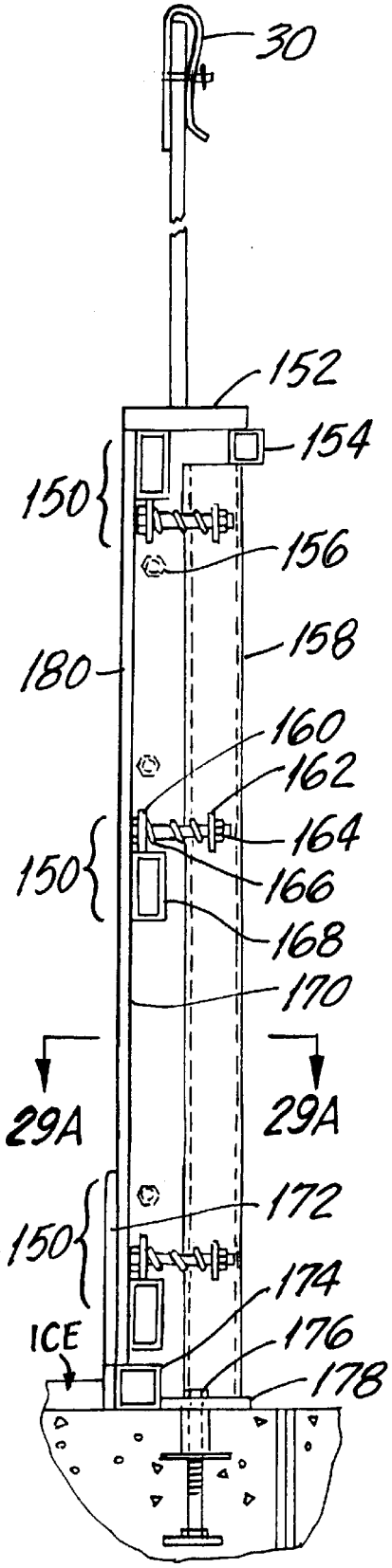
FIGS. 29 and 29A illustrate a cross-section view of a preferred embodiment dasher board assembly of the second aspect of the present invention having translational flexibility.
Figure 29A:
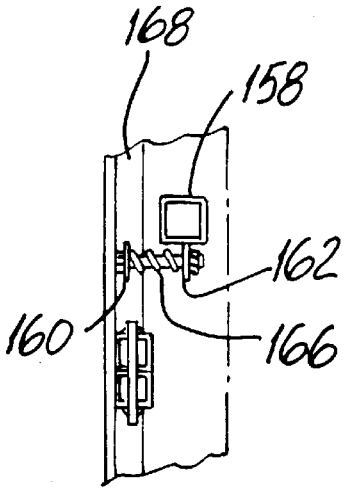

FIGS. 29 and 29A illustrate a preferred embodiment of this second aspect of the present invention, wherein the entire dasher board system is provided with translational flexibility, such that the entire dasher board assembly can be pushed substantially parallel with and away from the ice. In particular, FIG. 29 illustrates a cross section view of a dasher board assembly 12A, which comprises a series of vertically extending posts 158 that are each welded to a steel base plate 178. The base plate is secured to the concrete floor by an anchor 176. A fixed stringer 154 is disposed horizontally, and is welded to each of the vertical posts 158.

A panel assembly 180 comprises a planar facing section 170, which is adjoined to a horizontally extending sill 152, into which the shielding panel is inserted. Three stringers 168 extend horizontally across the panel assembly 180. Each stringer 168 comprises a lug 160 welded thereto as shown in FIG. 29.

The panel assembly 180 is movably joined to the posts 158 by a series of translational spring assemblies 150, whereby a bolt/locknut combination 164 that is used to connect lug 160 with an associated lug 162, and a spring 166 is inserted on the bolt 164 to provide the desired biasing. By providing three such translational spring assemblies 150 on each post 158, biasing is provided at the top, middle, and bottom portions of the dasher board assembly. The drawing in FIG. 29 illustrates a cross section showing one such post 158; in actuality the dasher board assembly will utilize two or three posts in this fashion.

Notably, the underside of the sill 152 is free to slide across the top of the stringer 154 when the dasher board assembly is subjected to a force. In addition, a tubular ice retainer 174 is fixed with respect to the floor, and provides the required stability for the ice such that ice will not creep into the dasher board assembly.

Figure 30A:
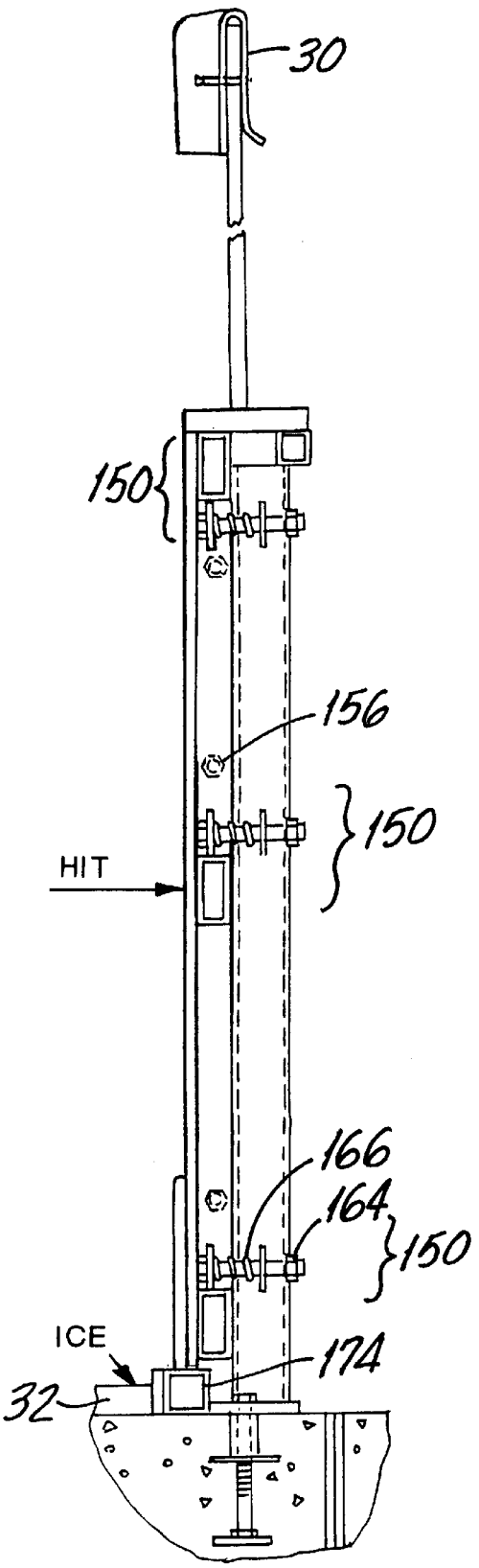
FIGS. 30A and 30B illustrate the operation of the dasher board assembly of FIG. 29.
Figure 30B:
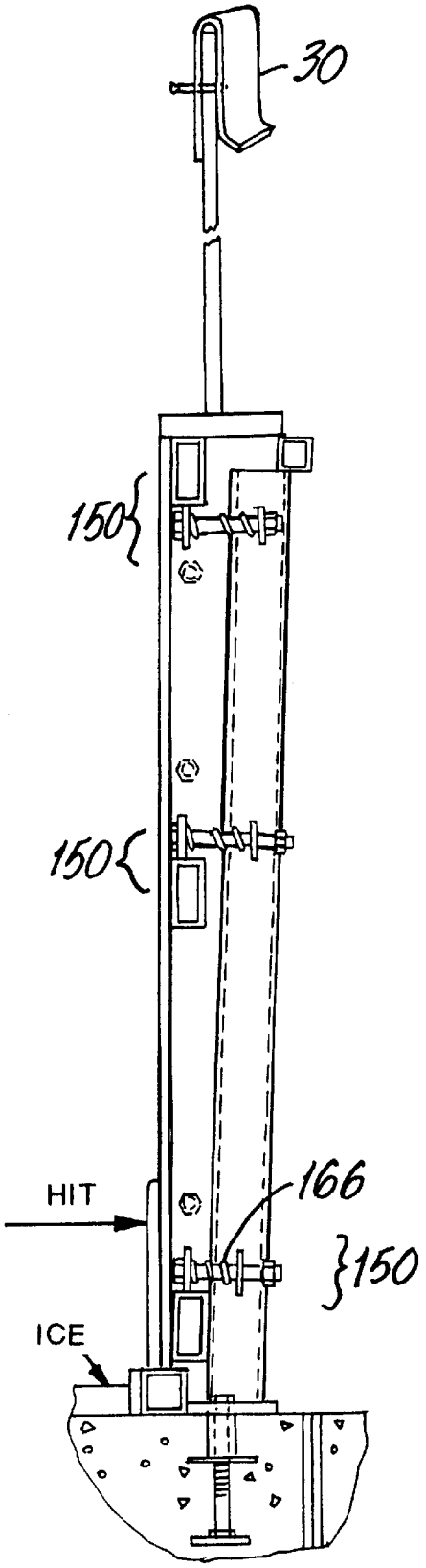

FIGS. 30A and 30B illustrate the operation of this embodiment when the dasher board assembly is subject to various forces by contact from a player. In FIG. 30A, a player strikes the approximate center of the panel assembly 180, and all three translational spring assemblies (upper, middle and lower) are compressed, and the entire panel assembly 180 moves toward the fixed posts 158, thus absorbing the shock imparted thereon by the player. When the force is removed, the bias action of the springs 166 causes the panel assembly 180 to return to its quiescent state.

In FIG. 30A, a player strikes the lower portion of the panel assembly 180, and the lower translational spring assembly is compressed, and the lower portion of the panel assembly 180 moves toward the fixed posts 158, thus absorbing the shock imparted thereon by the player. The middle translational spring assembly 150 may also be caused to move, but in a much lesser amount than the lower one. In addition, the upper translational spring assembly 150 may move, but again in a much lesser amount. When the force is removed, the bias action of the springs 166 causes the panel assembly 180 to return to its quiescent state.

3. Shielding Panel with Rotational Flexibility

In a third aspect of the present invention, the shielding panel is provided with rotational flexibility with respect to the dasher board assembly such that the shielding panel and its support struts will rotate about an axis where the panel is inserted into the dasher board (i.e. at the sill 214). This is shown in FIGS. 31A and 31B.

This embodiment differs from the previously described embodiments in one major respect since it utilizes a supportbased dasher board assembly, rather than the supportless design described above. Thus, a dasher board assembly 200, shown in cross section view, comprises a pair of support struts 202, into which a shielding panel 204 is inserted. The struts 202 extend through an opening in the sill 214; each has an angle bracket 208 affixed at the bottom end. The angle bracket is inserted within a bolt 209, along with a spring 212 as shown. The bolt 209 is fixed by conventional means to a stringer 206, which extends laterally across the dasher board assembly 200. FIG. 31B illustrates this assembly in a quiescent (upright) position.

Figure 31A:
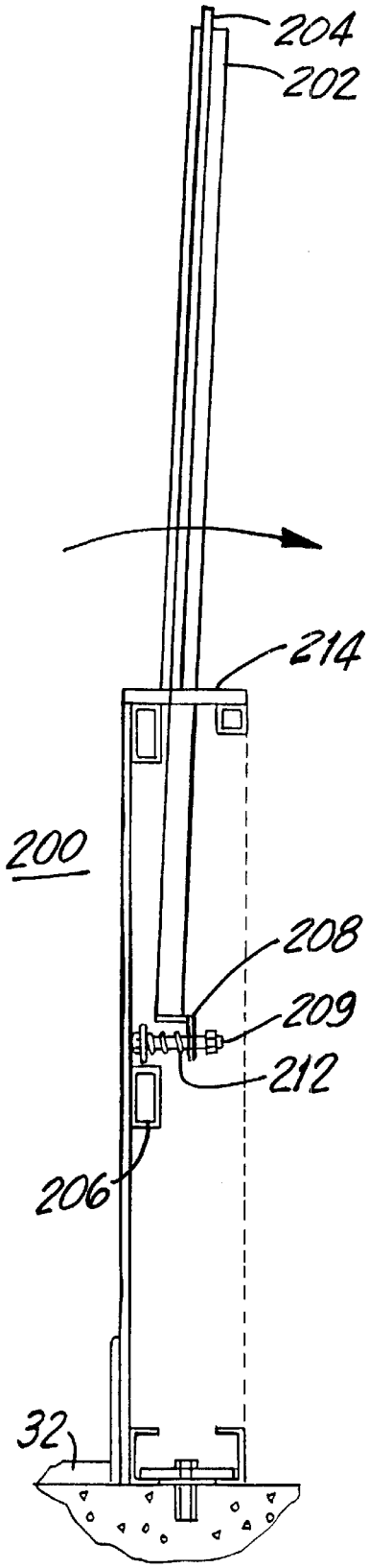
FIGS. 31A and 31B illustrate a dasher board assembly in accordance with a third aspect of the present invention having rotational flexibility of the shielding panel with respect to the dasher board.
Figure 31B:
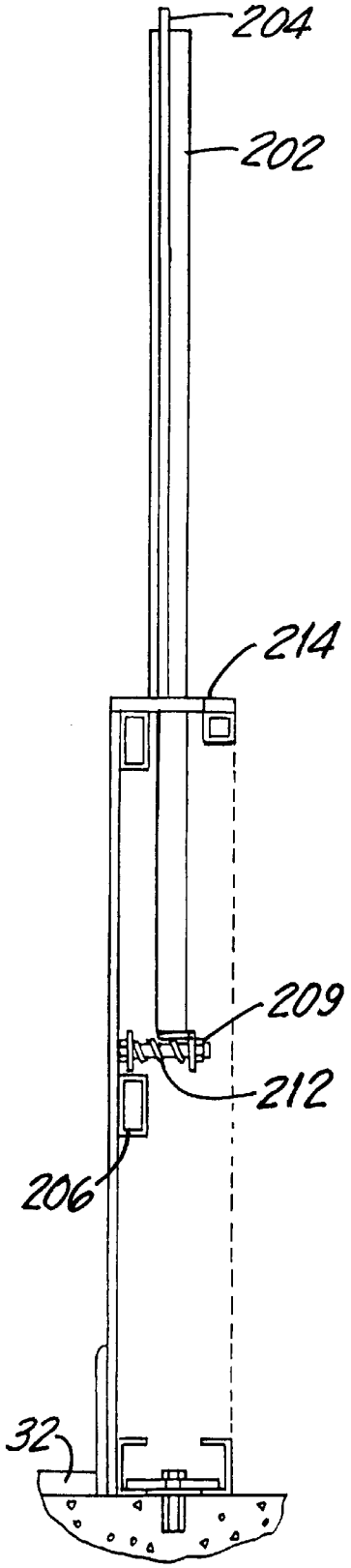

As shown in FIG. 31A, when a force is subjected on the shielding panel 204 as shown by the arrow, it is forced towards the non-ice side of the assembly 200, while the struts 202 rotate or pivot about the line along the sill 214, and thus the lower portion of the struts 202 are forced towards the ice side of the assembly 200. The spring 212 compresses, and tends to bias the assembly back towards its normal upright position after the force has on the panel has been removed.

Figure 32A:
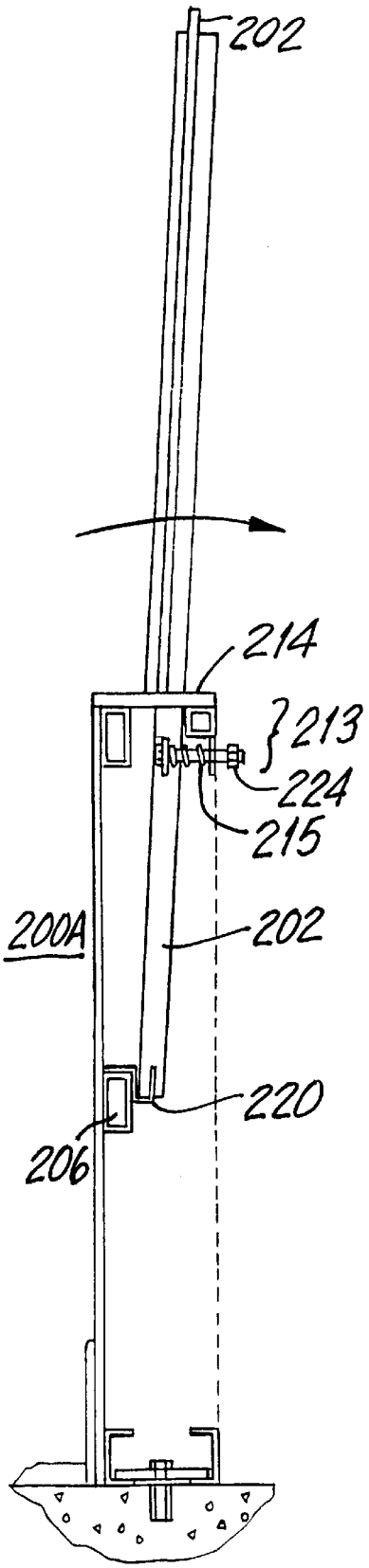
FIGS. 32A and 32B illustrate an alternative embodiment to the third aspect of the present invention.
Figure 32B:
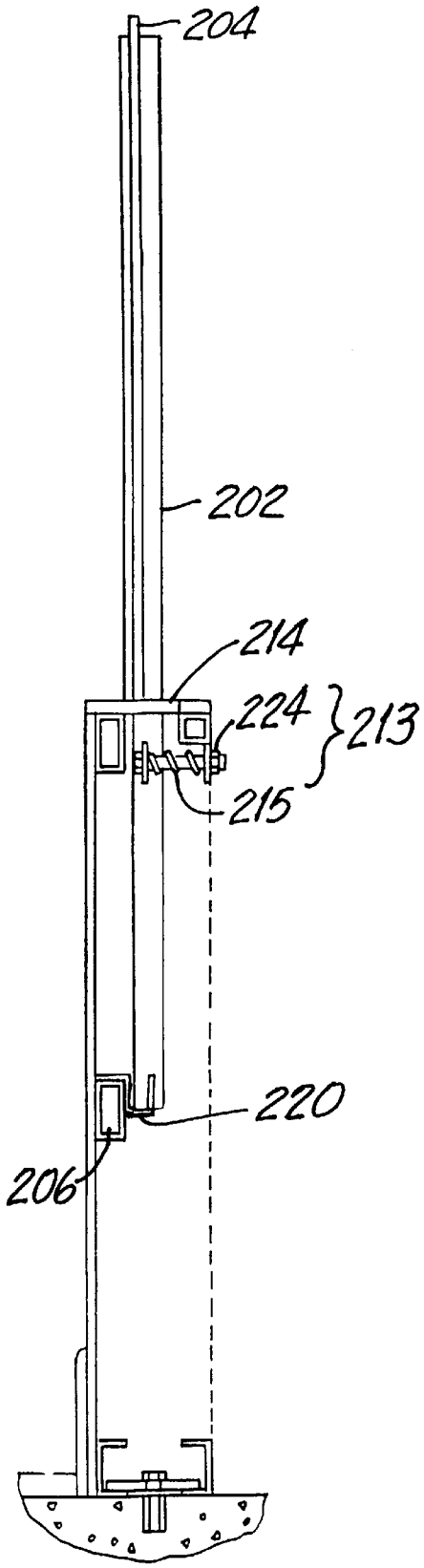

An alternative embodiment to this aspect of the invention is illustrated in FIGS. 32A and 32B. Here, dasher board assembly 200A utilizes a rotation axis located at the bottom of the struts 202, at the stringer 206 near the center of the dasherboard, rather than at the sill 214. Thus, a retaining member 220 is fixed to the stringer 206 such that the support strut 202 may rest and rotate upon it. A biasing assembly 213 is located near the sill 214, and comprises a bolt 224 and spring 215 fixed to the strut 202 as shown. The sill 214 comprises an opening large enough to allow the struts and/or bottom of the panel 204 to translate towards the non-ice side when a force is subjected a shown by the arrow. When this occurs, the panel and struts are caused to push towards the rear, compressing the spring 215 and pivoting about the retaining member 220. When the force is removed, the spring biases the entire assembly back to its upright position.

4. Shielding Panel with Translational Flexibility

Figure 33A:
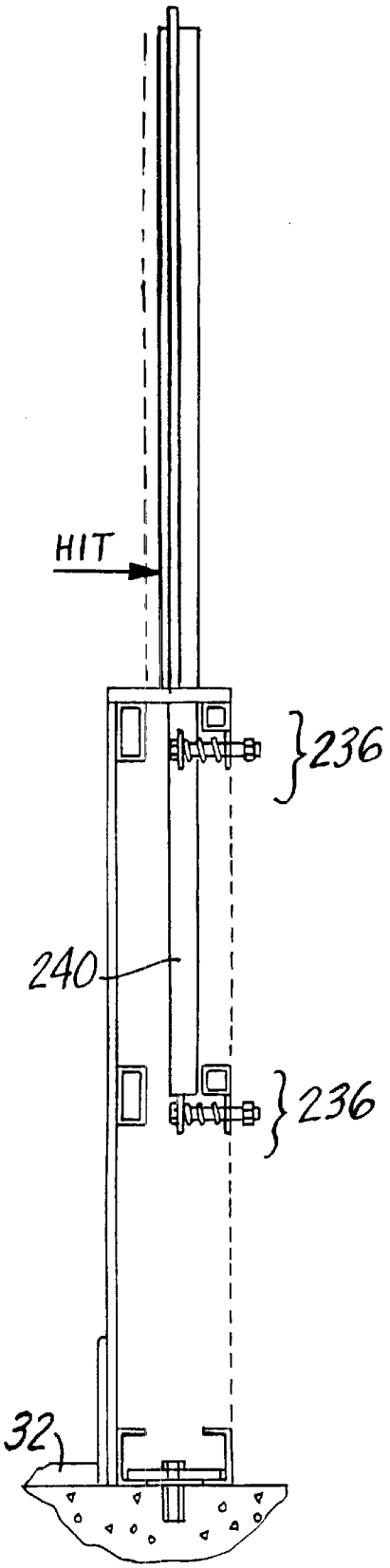
FIGS. 33A and 33B illustrate a dasher board assembly in accordance with a fourth aspect of the present invention having translational flexibility of the shielding panel with respect to the dasher board.
Figure 33B:
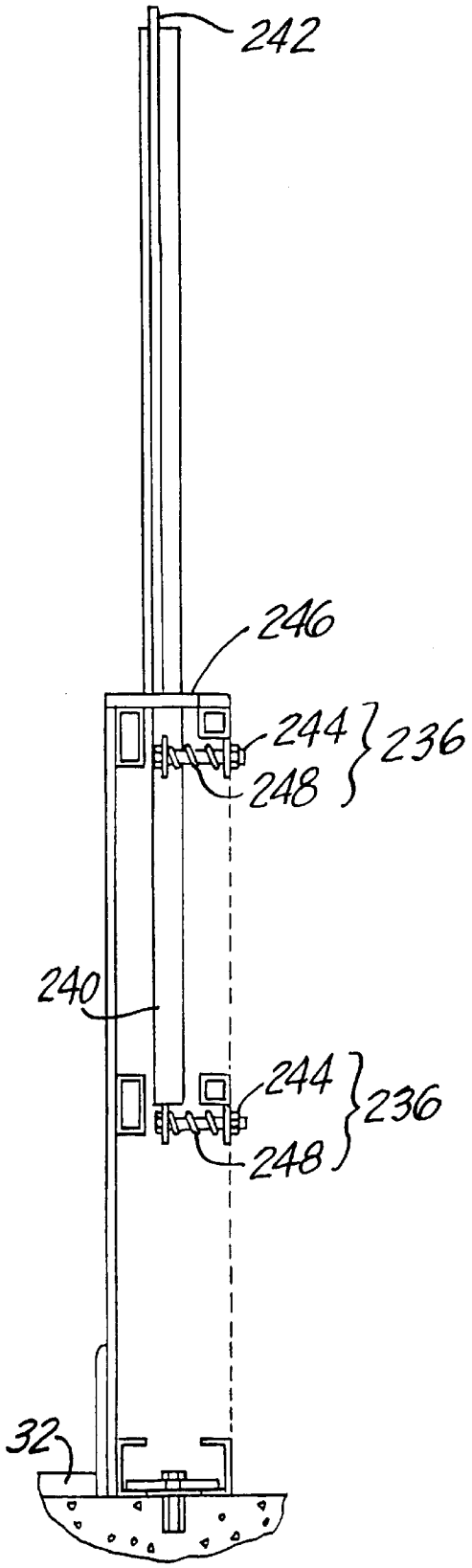

In a fourth aspect of the present invention, only the shielding panel is provided with translational flexibility such that only the shielding panel and its support struts can be pushed substantially parallel with and away from the ice. This is shown in FIGS. 33A and 33B.

This embodiment also utilizes a supported panel assembly, rather than the supportless type. A pair of biasing assemblies 236 are located as shown in FIG. 33B. The lower portion of the struts 240 are affixed to each biasing assembly 236, each of which comprises a bolt 244 and a spring 248. The biasing assembly, in a quiescent position, supports the struts in an upright manner as shown in FIG. 33B. When a force is subjected on the panel 242, an opening in the sill 246 allows the struts/panel to be moved away from the ice side, thereby compressing the springs 248. As such the panel/struts move away form the ice, providing the desired shock absorbing characteristics. When the force is removed, the biasing action of the springs 248 returns the assembly to its normal position.

We claim:

1. A flexible dasher board assembly comprising:

a lower frame adapted to be anchored to the ground;

an upper dasher board assembly located over the lower frame assembly, comprising means for receiving a shielding panel;

pivoting means for pivoting the upper dasher board assembly with respect to the lower frame when the upper dasher board assembly is subjected to a lateral force;

biasing means for biasing the upper dasher board assembly in an upright position when not subjected to a lateral force, the biasing means being compressible by the upper board assembly when subjected to a lateral force in order to allow the upper board assembly to pivot with respect to the lower frame.

2. The flexible dasher board assembly of claim 1 wherein the pivoting means comprises captivating means for captivating the lower frame with the upper dasher board assembly.

3. The flexible dasher board assembly of claim 2 wherein captivating means comprises a hinge assembly.

4. The flexible dasher board assembly of claim 1 wherein the pivoting means comprises an elongated member extending substantially laterally along the upper board assembly whereby a pivoting surface is formed between the elongated member and the lower frame assembly.

5. The flexible dasher board assembly of claim 4 further comprising means for restraining the upper dasher board assembly from disengaging from the lower frame when the upper dasher board assembly is subjected to a lateral force.

6. The flexible dasher board assembly of claim 5 wherein the upper dasher board assembly comprises a lower channel extending laterally along its length, the lower channel comprising a slot along its lower surface disposed between a pair of laterally extending flanges, and wherein the restraining means comprises a hold down plate assembly, the hold down plate assembly comprising a hold down plate affixed to an upper surface of the lower frame so as to provide a pair of laterally extending gaps therebetween sufficient to captivate the flanges of the lower channel.

7. The flexible dasher board assembly of claim 6 wherein the biasing means comprises a spring and a bolt assembly comprising a locknut, the bolt assembly inserted through a retaining portion of the lower channel, the spring being captivated by the locknut and the retaining portion, the bolt assembly adapted such that a lower surface of the bolt is substantially in contact with the lower frame assembly, the spring tending to compress between the locknut and the retaining portion when a lateral force is imparted on the upper dasher board assembly, the spring tending to bias the upper dasher board assembly in an upright position when no lateral force is imparted on the upper dasher board assembly.

8. A flexible dasher board system comprising:

a plurality of flexible dasher board assemblies interconnected to form an arena for playing a game, each of the flexible dasher board assemblies comprising:

a lower frame adapted to be anchored to the ground;

an upper dasher board assembly located over the lower frame assembly, comprising means for receiving a shielding panel;

pivoting means for pivoting the upper dasher board assembly with respect to the lower frame when the upper dasher board assembly is subjected to a lateral force; and biasing means for biasing the upper dasher board assembly in an upright position when not subjected to a lateral force, the biasing means being compressible by the upper board assembly when subjected to a lateral force in order to allow the upper board assembly to pivot with respect to the lower frame; and compressible bolt means for flexibly connecting adjacent pairs of flexible dasher board assemblies, each of the compressible bolt means tending to keep adjacent pairs of flexible dasher board assemblies in substantial alignment with each other in the absence of a later force on any of the flexible dasher board assemblies and allowing for movement of the flexible dasher board assemblies with respect to each other when subjected to a lateral force.

9. The flexible dasher board system of claim 8 further comprising:

a plurality of shielding panels, each of the shielding panels associated with a flexible dasher board assembly and captivated by the means for receiving a shielding panel; and a plurality of retaining clips, each of the clips configured to receive a top portion of a shielding panel, each of the clips removably attached to tops of adjacent pairs of shielding panels to flexibly align the shielding panels.

10. The flexible dasher board system of claim 8 wherein the upper board assemblies each comprises a pair of vertical posts located at each end thereof, and wherein the compressible bolt means each comprises a bolt and a pair of spring washers, the bolt inserted through the spring washers and a hole in a post of each adjacent upper board assembly and captivated with a nut, whereby the captivated adjacent posts are caused to be in substantial alignment with each other in the absence of a later force on any of the flexible dasher board assemblies and allow for movement of the flexible dasher board assemblies with respect to each other when subjected to a lateral force.

11. A flexible dasher board assembly comprising:

a rear base portion adapted for mounting to a floor;

a front board portion adapted for carrying a shielding panel; and means for slidingly mounting the front board portion with respect to the rear base portion, comprising biasing means for aligning the front board portion with the rear base portion;

wherein the biasing means is adapted to allow the front board portion to slide towards the rear base portion when a lateral force is applied against the front board portion.

12. The flexible dasher board system of claim 11 wherein the front board portion comprises an upper sill extending laterally across the front board portion suitable for receiving a shielding panel, and wherein the means for slidingly mounting the front board portion with respect to the rear base portion comprises a stringer extending laterally across the rear base portion, the upper sill resting on top of the stringer and capable of sliding across the stringer when a lateral force is applied against the front board portion.

13. The flexible dasher board system of claim 12 wherein the means for slidingly mounting the front board portion with respect to the rear base portion comprises a plurality of translational spring assemblies, each of the translational spring assemblies comprising a bolt/locknut combination connected between a first lug associated with the front board portion and a second lug associated with the rear base portion and captivating therebetween a biasing spring, the biasing springs tending to cause the front board portion to remain in predetermined juxtaposition with the rear base portion in the absence of a lateral force on the front board portion, and allowing the front board portion to slide towards the rear base portion when a lateral force is applied against the front board portion.

* * * * *